US007159291B2

(12) United States Patent
Ohuchi

(10) Patent No.: US 7,159,291 B2
(45) Date of Patent: Jan. 9, 2007

(54) CONTINUOUS RIVETER AND CONTINUOUSLY CAULKING METHOD OF BLIND RIVETS

(75) Inventor: Masatoshi Ohuchi, Koriyama (JP)

(73) Assignee: Opt Engineering Co., Ltd. (JP)

( * ) Notice: Subject to any disclaimer, the term of this patent is extended or adjusted under 35 U.S.C. 154(b) by 383 days.

(21) Appl. No.: 10/482,672

(22) PCT Filed: Jul. 18, 2003

(86) PCT No.: PCT/JP03/09214

§ 371 (c)(1),
(2), (4) Date: Dec. 31, 2003

(87) PCT Pub. No.: WO2005/007318

PCT Pub. Date: Jan. 27, 2005

(65) Prior Publication Data

US 2005/0115040 A1 Jun. 2, 2005

(51) Int. Cl.
*B21J 15/22* (2006.01)
*B21J 15/06* (2006.01)
*B25C 1/04* (2006.01)

(52) U.S. Cl. ..... 29/243.525; 29/243.523; 29/812.5; 72/391.6; 227/57; 227/112

(58) Field of Classification Search ..... 29/812.5, 29/243.523, 243.525; 72/391.6; 227/57, 227/112

See application file for complete search history.

(56) References Cited

U.S. PATENT DOCUMENTS 4,118,969 A 10/1978 Corbett
4,515,005 A 5/1985 Klein
4,598,571 A 7/1986 Oefinger
4,648,258 A 3/1987 Frearson
4,704,888 A 11/1987 Frearson
5,090,607 A * 2/1992 Ohuchi et al. ..... 72/391.6
5,205,456 A * 4/1993 Ohuchi et al. ..... 29/243.525
5,544,407 A * 8/1996 Ohuchi et al. ..... 29/525.06
5,651,169 A * 7/1997 Ohuchi et al. ..... 29/243.525
6,029,814 A * 2/2000 Ohuchi ..... 206/347
6,098,442 A * 8/2000 Walldorf et al. ..... 72/391.6
6,163,945 A * 12/2000 Amano et al. ..... 29/243.523
6,301,948 B1 10/2001 Weiland (Continued)

FOREIGN PATENT DOCUMENTS

CA 1 075 209 4/1980

(Continued)

*Primary Examiner*—David Jones
(74) *Attorney, Agent, or Firm*—McGlew & Tuttle, PC

(57) ABSTRACT

Disclosed is a continuous riveter capable of firing blind rivets in succession to caulk sheet metal or the like. A seal member 71 located on the oil chamber 6 side and a seal member 72 located on the air chamber 4 side are provided in an oil cylinder 1 where an oil piston 2 separates the oil chamber 6 of the oil cylinder 1 from the air chamber 4 of an air cylinder 3, and a portion of the oil cylinder 1 which is between seal members 71 and 72 is provided with an air vent 19; and a seal member 74, 76 located on the oil chamber 16 side and a seal member 73, 77 located on the air chamber 14, 15 side are provided in a jaw case piston 20 and in a nose piston 28, the seal members 74, 76 and 73, 77 sealing an area between the oil chamber 16 and the air chamber 14, 15, and the pistons 20 and 28 between the seal members 74, 76 and 73, 77 are each provided with an air vent 75, 78.

7 Claims, 34 Drawing Sheets

U.S. PATENT DOCUMENTS

| | | | | |
|---|---|---|---|---|
| 6,519,997 | B1 * | 2/2003 | Luhm et al. | 72/391.6 |
| 6,629,360 | B1 * | 10/2003 | Ohuchi | 29/812.5 |
| 2001/0054221 | A1 | 12/2001 | Ohuchi | |

FOREIGN PATENT DOCUMENTS

| | | | |
|---|---|---|---|
| CA | 1 256 409 | | 6/1989 |
| DE | 199 17 018 | | 12/1999 |
| EP | 0 062 206 | A2 | 10/1982 |
| EP | 0 201 292 | | 11/1986 |
| EP | 0 201 293 | | 11/1986 |
| EP | 1 023 957 | A2 | 8/2000 |
| JP | 61-259852 | | 11/1986 |
| JP | 2003-103336 | | 4/2003 |

* cited by examiner 10
12
D
60
9
P4
20
14
R1
13
16
2
3
4
7
1
6
E
18
28
21
29
51
24
23
25
15
32
31
17
R1
P5
T1
T
T2
44
43
T4
R
F
48
R2
47
P2
P3
P1
27

CONTINUOUS RIVETER AND CONTINUOUSLY CAULKING METHOD OF BLIND RIVETS

TECHNICAL FIELD

The present invention relates to a continuous riveter capable of firing blind rivets (hereinafter referred to as rivets) in succession to caulk sheet metal or the like, and to a continuous caulking method of rivets.

BACKGROUND ART

The inventors of the present invention have filed a Japanese patent application, JP 2003-103336 A, for a continuous riveter shown in FIGS. 12 through 34. This continuous riveter is composed of a main body D, a driver section E, a rivet supplying section F, and a valve section G. FIGS. 12 and 13 show the riveter with a push button of a trigger valve released. FIGS. 14 through 19 show the riveter with the push button of the trigger valve pushed.

The driver section E has a small-diameter oil cylinder 1 which branches away from the main body D to extend sideways and a large-diameter air cylinder 3 which drives an oil piston 2 of the oil cylinder 1.

The oil piston 2 serves as a piston rod of a piston 7 installed in the air cylinder 3, and the oil piston 2 and the piston 7 are unitarily formed.

The oil cylinder 1 is communicated with a chuck cylinder 8 through a hole 18 leading to an oil chamber 16, which is a space created between a jaw case piston 20 and a nose piston 28 in the chuck cylinder 8.

Denoted by P2 is a second port for supplying compressed air to a piston anterior chamber 4 of the air cylinder 3 and to an air chamber 15 (FIG. 16) that is located between the nose piston 28 and a rod cover 17. The second port P2 is communicated with a port f (FIG. 13), which is one of the exit side ports of an operation valve 53.

Denoted by P1 is a first port for supplying compressed air to a posterior chamber 5 (FIG. 14) that is positioned behind the piston of the air cylinder 3. The first port P1 is communicated with a port e, which is the other of the exit side ports of the operation valve 53 described later.

Denoted by P3 is a third port for supplying, at an advanced position of the piston 7 (FIG. 14), compressed air of the posterior chamber 5 of the air cylinder 3 to a pilot air circuit Y of the operation valve 53.

A storage case 47 of the rivet supplying section F is fixed to the lower end of the air cylinder 3 with a pin 27.

The oil cylinder 1 and the chuck cylinder 8 of the main body Dare unitarily formed while positioned at approximately right angles with respect to each other. A shank storing case 9 for receiving a shank R1, which is cut off of a blind rivet R, is set in an upper part of the interior of the main body D. The rivet supplying section F is attached to a lower part of the exterior of the main body D.

A vacuum ejector 12 for vaccumizing the interior of the shank storing case 9 is attached to the upper end of the shank storing case 9.

The chuck cylinder 8 has the rod cover 17 attached to its lower end, and has the jaw case piston 20 in its interior. The jaw case piston 20 is a bowl-shaped piston which opens at its upper end. When set in place, the jaw case piston 20 serves as a partition between an air chamber 14 which is above the jaw case piston 20 and the oil chamber 16 which is below the jaw case piston 20.

Positioned below the jaw case piston 20 is a tubular jaw case 21, which is fixedly attached to the lower end of the bowl-shaped piston. The inner face of the front end of the jaw case 21 is a tapered face 22 whose diameter gradually decreases toward the front end. A pair of jaws 25 are slidably inserted into the tapered face 22.

The jaws 25 are biased downward by a spring 23, which is housed in the jaw case 21, through a jaw pusher 24 having a sharp tip.

A shank recovery pipe 13 is inserted in the jaw case 21 and is inserted into the shank storing case 9 with the top of the shank recovery pipe 13 piercing a bottom plate of the shank storing case 9.

The nose piston 28 is placed below the jaw case piston 20, and serves as a partition between the oil chamber 16 which is above the nose piston 28 and the air chamber 15 which is below the nose piston 28. A tubular body 29 formed on the lower end of the nose piston 28 is slidably inserted through the rod cover 17, which forms the lower end of the chuck cylinder 8, and extends to the outside of the cylinder 8. A nose piece 32 is fit in the lower end of the tubular body 29.

In the state shown in FIGS. 12, 16, 17, and 18, the front end of the jaw case 21 is in contact with a lower wall 30 (FIG. 21) of the tubular body 29 and the front ends of the jaws 25 are in contact with the nose piece 32 protruding from the lower wall 30 in a V shape.

The vacuum ejector 12 is constantly in operation while the continuous riveter is in use, and collects, by suction through the shank recovery pipe 13, the shank R1 of the rivet R which is cut off upon caulking in the shank storing case 9. At the same time, the vacuum ejector 12 holds by a suction force a rivet that is inserted in the jaw portion of the jaw case 21 from the nose piece 32 of the tubular body 29 of the nose piston 28. The vacuum ejector 12 is therefore communicated directly with a compressed air source 50 through a conduit 60.

The above-described structure allows the vacuum ejector 12 to run constantly while the continuous riveter is in use. In this way, the suction force constantly acts on the shank recovery pipe 13, and through the shank recovery pipe 13, on the nose piece 32 at the front end of the tubular body 29 and on the jaws 25. Not only that the shank R1 cut off of the rivet R upon caulking is thus collected in the shank storing case 9 through the shank recovery pipe 13, but also that the suction force acts also on the rivet R inserted into the nose piece 32 from the front end of the tubular body 29 so that the rivet R can be held while being prevented from falling off.

As shown in FIGS. 12, 14, 16 through 18, and 20, the rivet supplying section F is equipped with a tape air cylinder 37 (see FIG. 20), a guide plate 43, and the storage case 47 for a rivet holder belt T.

The tape air cylinder 37 houses a tape piston 39 biased in a return direction by a spring 38 as shown in FIG. 20. A feed claw 41 is fixedly attached to a shaft 40 of the tape piston 39.

The guide plate 43 has, in section, a shape of the mirror image of the letter C to adapt to the rivet holder belt T and guide the rivet holder belt T. An elongated hole 44 is formed in the vertical face of the guide plate 43. The feed claw 41 protrudes from the elongated hole 44 so as to be capable of reciprocal movement. As shown in FIG. 20, the vertical face of the guide plate 43 also has a spring plate 46 for guiding the rivet holder belt T by pressing a vertical portion of the rivet holder belt T.

The blind rivet holder belt T (or rivet holder belt T) is formed of synthetic resin or paper, and as shown in FIG. 26, has an elongated body that is shaped in section like the mirror image of the letter C. The vertical portion of the rivet holder belt T is denoted by T3 and has rectangular upper tabs T1 and lower tabs T2 along its upper and lower edges at regular intervals. One upper tab T1 and one lower tab T2 make one pair. One pair of upper and lower tabs is separated from the next pair by a gap T7. The vertical portion T3 has feed holes which are each denoted by T4 and which are bored at regular intervals. A through hole T5 is formed in each upper tab T1 and in each lower tab T2. To set the rivet R in the belt, the rivet R is inserted from below the lower tab T2 into the through hole T5 of the lower tab T2 and the through hole T5 of the upper tab T1 until a head portion R3 of the rivet R comes into contact with the top face of the lower tab T2.

Such rivet holder belt T is stored in the storage case 47 in a wound state, and fed through the guide plate 43 from the front end first. Feeding of the rivet holder belt T is achieved by reciprocating motion of the tape piston 39 of the tape air cylinder 37 with the feed claw 41 engaged with the feed hole T4 of the rivet holder belt T.

The valve section G is as shown in FIGS. 13, 15, and 19. The operation valve 53 is attached to the air cylinder 3 at a position indicated by a dot-dash line. Denoted by 2 is a position pilot switching valve. Designated by 49 is a trigger valve attached at a position indicated by an inner dot-dash line, where the oil cylinder 1 and the chuck cylinder 8 intersect with each other. The trigger valve 49 is for pushing or releasing a push button 51.

In the drawings, reference numeral 50 represents a compressed air source such as a compressor, and ports h and o are opened to the air. The exit side ports e and f of the operation valve 53 are communicated with the first and second ports P1 and P2, respectively. The third port P3 is communicated with the pilot air circuit Y.

An exit side port m of the trigger valve 49 is communicated with a pilot air circuit X of the operation valve 53 and with a fourth port P4, which is at the upper end of the chuck cylinder 8. A port n of the trigger valve 49 is communicated with an entrance side port g of the operation valve 53.

A fifth port P5 is provided in the rod cover 17. The air chamber 15 is communicated with a port k of the tape air cylinder 37 through the fifth port P5, so that compressed air in the air chamber 15 is supplied to the tape air cylinder 37 through the port P5 from a groove 31 in a lower part of the tubular body 29 (FIG. 19) when the nose piece 28 rises to its upper dead point (FIG. 18).

The above-described continuous riveter of the prior art operates as follows.

The rivet holder belt T is stored in the storage case 47 of the continuous riveter usually in a wound state. When caulking is not performed, the riveter is in the state shown in FIGS. 12 and 13 with the push button 51 (trigger) released and the rivet R held in the nose piece 32 by the suction force of the vacuum ejector 12, thus preventing the rivet R from falling off.

When a rivet main body R2 of the rivet R is inserted in a hole of sheet metal 48 and the push button 51 is pushed as shown in FIG. 14, the trigger valve 49 moves as shown in FIG. 15 to cause compressed air to flow from a port s to the port n, then from the port g of the operation valve 53 to its port e, and then from the first port P1 into the posterior chamber 5 of the air cylinder 3. The air flow advances the piston 7, thereby advancing the oil piston 2 and causing oil in an oil chamber 6 to flow into the oil chamber 16 of the chuck cylinder 8. This pushes the jaw case piston 20 up by a certain distance and the jaw case 21 is accordingly raised.

In this case, the pair of the jaws 25 which are biased downward and brought into contact with the nose piece 32 by the spring 23 through the jaw pusher 24 depart from the nose piece 32 and move downward while sliding along the tapered face 22 of the jaw case 21. Due to the tapered face 22, the jaws 25 approach each other. This makes it possible for the jaws 25 to hold the shank R1 of the rivet R while the jaws 25 make an ascent. The ascent of the shank R1 effects caulking using the rivet R and then the shank R1 is cut off as the head portion R3 of the rivet R is stopped at the front end of the nose piece 32.

In this case, the air chamber 15 and the anterior chamber 4 of the air cylinder 3 are opened to the air through the second port P2 and the ports f and h of the operation valve 53, and thus the nose piston 28 is pushed downward and the jaw case piston 20 alone makes an ascent.

When the piston 7 is advanced as described above, compressed air in the posterior chamber 5 is supplied to the pilot air circuit Y through the third port P3 to advance the operation valve 53 so that the state shown in FIGS. 18 and 19 is reached. Then, compressed air from the compressed air source 50 flows through the ports s, n, g, and f in this order and is supplied to the second port P2. The compressed air of the posterior chamber 5 of the air cylinder 3 flows through the ports e and h in the order stated and is released into the atmosphere whereas compressed air of the pilot air circuit X and compressed air of the air chamber 14 flow from the third port 3 to the port m and then to the port o to be released into the atmosphere.

The jaw case piston 20 and the nose piston 28 are thus raised to their respective upper dead points as shown in FIGS. 16 through 18.

In FIG. 16, the oil piston 2 (and accordingly the piston 7) has returned and the nose piston 28 has risen to a position near the bowl-shaped piston to let compressed air blow into the vacuum ejector 12. The interior of the shank storing case 9 is therefore held under a vacuum. The nose piston 28 rises relative to the jaw case piston 20 to bring the lower wall 30 of the tubular body 29 into contact with the lower end of the jaw case 21. At the same time, the upper end of the nose piece 32 pushes the front ends of the jaws 25 up to unlock the jaws 25.

In FIG. 17, the jaw case piston 20 and the nose piston 28 each have finished halfway through their ascent and the shank R1 has been sucked into the shank storing case 9 through the shank recovery pipe 13.

In FIG. 18, the jaw case piston 20 and the nose piston 28 each have reached their respective upper dead points. With the pistons 20 and 28 at their respective upper dead points, compressed air is supplied from the fifth port P5 to the port K of the tape air cylinder 37 to send the tape piston 39 forward. This advances the feed claw 41 from one elongated hole 44 to another. Engaged with the feed hole T4 of the rivet holder belt T, the feed claw 41 pulls the rivet holder belt T out of the storage case 47 and moves the rivet holder belt T by one pitch along the guide plate 43. The tip of the shank R1 is thus set on the axial center below the nose piece 32.

Next, the push button 51 is released to bring the valve section G into the state shown in FIG. 13. The trigger valve 49 is returned to its original position by the force of the spring 52, thereby supplying compressed air of the compressed air source 50 to the pilot air circuit X of the operation valve 53 through the port m. This causes the operation valve 53 to retreat. At this point, compressed air of the pilot air circuit Y flows through the ports P3 and P2 in this order and then from the port f to the port h to be released into the atmosphere.

At the above valve position, compressed air flows through the port s of the trigger valve 49 and then the port m to be supplied to the air chamber 14 from the fourth port P4 whereas the compressed air in the air chamber 15 flows through the ports P2, f, and h in the order stated to be released into the atmosphere. This action causes both the jaw case piston 20 and the nose piston 28 to descend to their respective lower dead points, thereby putting the shank R1 of the rivet R in the opened jaws 25 through the nose piece 32 to be held. At the same time, the front end of the nose piece 32 descends while bending the upper and lower tabs T1 and T2 of the rivet holder belt T downward. The descent of the nose piece 32 will be described later with reference to FIGS. 21 through 24.

While the nose piece 32 descends, the supply of compressed air to the tape air cylinder 37 is stopped, allowing the compressed air in the tape air cylinder 37 to escape. The tape piston 39 therefore retreats to its initial position by the action of the spring 38. On the other hand, the rivet holder belt T which is prevented from moving in the reverse direction by a reversal stopper claw 45 remains stopped while the feed claw 41 is disengaged from the feed hole T4 and moved one pitch forward to engage with the next feed hole T4.

At this point, the rivet holder belt T is elastically pressed against the guide plate 43 by the guiding (misalignment preventing) spring plate 46 and therefore is securely engaged with the feed claw 41 without misalignment.

Preparations for the next caulking of a rivet T are thus completed.

The subsequent operations are identical with those described in the above. By repeating the above operations, caulking using the rivet R can be made in succession.

FIGS. 21 through 24 show how the nose piece 32 descends. In FIG. 21, one rivet R is fed and the head portion R3 of the rivet main body R2 is positioned inside the lower tab T2.

In FIG. 22, the shank R1 is inserted in the nose piece 32 while the front end of the nose piece 32 is in the process of bending the upper tab T1.

In FIG. 23, the nose piece 32 descends further to bend the upper tab T1 thoroughly. The shank R1 pierces through the nose piece 32 to be loosely inserted in the jaws 25. The head portion R3 of the rivet main body R2 is in contact with the front end of the nose piece 32 and has bent the lower tab T2 a little. The proximal end of the lower tab T2 is supported by the guide plate 43. With the support of the guide plate 43 and the resistance met by the head portion R3 in bending the lower tab T2, the rivet R is completely inserted into the nose piece 32 until stopped at the head portion R3.

In FIG. 24, the nose piece 32 has reached its lower dead point with the rivet R completely inserted in the nose piece 32. The lower tab T2 has been bent thoroughly though omitted from the drawing. FIG. 25 is an enlarged sectional view showing the nose piece 32 of the conventional tubular body 29.

Alternatively, the rivet supplying section F may be as shown in FIGS. 28 through 34. FIG. 28 is a bottom view and FIG. 29 is a view as seen from the direction of the arrow A—A of FIG. 28. FIG. 30 is a side view and FIG. 31 is a perspective view showing a guide plate portion. Structural components that are identical with those in the above-described prior art are denoted by the same reference symbols.

As shown in FIGS. 28 through 34, the guide plate 43 extended from the storage case 47 of the rivet supplying section F has a linear feed portion 43*a* of a given length, and has, beyond the linear feed portion 43*a*, a bent portion 43*b* where the direction of the vertical portion T3 of the rivet holder belt T is bent at a given angle β. The bent portion 43*b* of the guide plate 43 has a pressing plate 61, which guides the rivet holder belt T by pressing down on the vertical portion T3 of the rivet holder belt T and which stretches over a guide surface from the linear feed portion 43*a* to the bent portion 43*b*. An end 61*a* of the pressing plate 61 to which the rivet holder belt T advances is tapered to gradually widen in order to facilitate the ingress of the rivet holder belt T. Owing to the pressing plate 61, the blind rivet holder belt T that has been fed linearly is securely guided from the linear feed portion 43*a* to the bent portion 43*b* to be bent at the bent portion 43*b*.

The guide plate 43 is for guiding the rivet holder belt T, and as shown in FIGS. 29 and 31, has guide walls 62, 62 to ensure that the blind rivet holder belt T travels without falling off the guide plate 43. The elongated hole 44 which enables the feed claw 41 to make a linear reciprocating motion is opened in the linear feed portion 43*a* of the guide plate 43. The tip of the feed claw 41 protrudes from the elongated hole 44. As shown in FIG. 28 (and FIG. 20), the feed claw 41 is coupled to the piston 39 of the tape air cylinder 37, and the tape air cylinder 37 puts the feed claw 41 into a linear reciprocating motion. The feed claw 41 is engaged with the feed hole T4 of the rivet holder belt T as shown in FIG. 32 and the rivet holder belt T is sent forward by one rivet in conjunction with the linear advance of the feed claw 41.

FIGS. 31 through 34 show step by step how the guide plate 43 is used. First, from the state shown in FIG. 31, the feed claw 41 sends the rivet holder belt T forward by one rivet as shown in FIG. 32. The rivet holder belt T thus enters the area under the pressing plate 61 and is bent along the bent portion 43*b* of the guide plate 43. At this point, the vertical portion T3 of the rivet holder belt T enters the area under the pressing plate 61 and is guided without fail because the front end 61*a* of the pressing plate 61 is tapered to gradually widen. Immediately after the belt is bent, the shank R1 of the rivet R arrives at a position that coincides with the axial center of the tubular body 29 of the nose piston 28 as shown in FIG. 32.

Then, the continuous riveter is put into operation to perform "caulking". Because the rivet holder belt T is being bent at that moment, a gap L is created as shown in FIG. 28 between a pair of the upper and lower tabs T1 and T2 situated in the bent portion 43*b* at a portion immediately past the position where the rivet holder belt T extending from the linear feed portion 43*a* is bent and a pair of the upper and lower tabs T1 and T2 situated in the linear feed portion 43*a* at a position immediately before the bend position. The gap L prevents the pair of the upper and lower tabs T1 and T2 situated immediately before the bend position from bumping into the descending tubular body 29 as shown in FIG. 33. This makes it possible to reduce the interval between one rivet R and another rivet R as much as possible as compared with the prior art as shown in FIG. 28. In addition, the upper and lower tabs T1 and T2 on the bent portion 43*b* do not interfere with descent of the tubular body 29 since the rivet R has already been put in use and is no longer held by the upper and lower tabs (see FIG. 34).

As a result, because the interval (pitch) between one rivet R and another rivet R in the rivet holder belt T can be set small, the number of rivets R loaded per a given length of the rivet holder belt T can be increased and more rivets can be stored in the storage case 47 than in the prior art.

However, the conventional continuous riveter has a problem. That is, between the air chambers 4, 14, and 15 and the oil chambers 6 and 16 defined by the oil piston 2, the jaw case piston 20, and the nose piston 28, compressed air of the air chambers 4, 14, and 15 infiltrates into oil in the oil chambers 6 and 16 after repeated use, causing air bubbles in the oil. As a result, residual pressure develops in the oil, which leads to a failure in carrying out predetermined operations with reliability.

This point will be described in detail referring to drawings. FIG. 35 is an enlarged view corresponding to a portion A of FIG. 1. The piston 7 of the air cylinder 3 and the oil piston 2 of the oil cylinder 1 are unitarily formed, and the oil piston 2 separates the oil chamber 6 in the oil cylinder 1 from the air chamber 4 of the air cylinder 3. The oil cylinder 1 is sealed by a gasket 72 in order to prevent compressed air of the air chamber 4 from entering the oil chamber 6, and is sealed by a gasket 71 in order to prevent oil of the oil chamber 6 from entering the air chamber 4.

In the return step of the oil piston 2 (the step where the state of FIG. 14 is returned to the state of FIG. 16), however, compressed air supplied from the port P2 to the air chamber 4 of the air cylinder 3 pushes the air piston 7 back and accordingly the oil piston 2 is pulled to retreat. At this point, the oil side in the oil cylinder 1 (oil chamber 6) is pulled by the oil piston 2 and is set under negative pressure. Despite the sealing effected by the gaskets 71 and 72 for preventing air infiltration, repeated operation causes compressed air to enter the space between the gaskets 71 and 72 gradually in small amounts. The infiltrated air accumulates and ultimately climbs over the gasket 71, which borders the oil chamber 6, to enter the oil chamber 6 and cause air bubbles in the oil.

FIG. 36 is an enlarged view corresponding to a portion B of FIG. 1. The upper portion is the air chamber 14 defined by the jaw case piston 20 and the lower portion is the oil chamber 16. Gaskets 73 and 74 are provided in the jaw case piston 20 in order to prevent compressed air of the air chamber 14 from entering the oil chamber 16. However, repetition of the reciprocating motion of the jaw case piston 20 inevitably leads to infiltration of a minute amount of air into the space between the gaskets 73 and 74. The infiltrated air is gradually increased in pressure up to the level of the compressed air to rise and ultimately enter the oil chamber 16 from the gasket 74 as the oil side is put under negative pressure in the return step of the jaw case piston 20. Thus air bubbles are formed in the oil.

FIG. 37 is an enlarged view corresponding to a portion C of FIG. 1. The upper portion is the oil chamber 16 defined by the nose piston 28 and the lower portion is the air chamber 15. Gaskets 76 and 77 are provided in the nose piston 28 in order to prevent compressed air of the air chamber 15 from entering the oil chamber 16. The nose piston 28 rises when compressed air is supplied to the air chamber 15, and is lowered when the oil chamber 16 receives hydraulic pressure. Therefore, repetition of the reciprocating motion of the nose piston 28 causes air to gradually infiltrate in small amounts from the gasket 77 into the space between the gaskets 76 and 77. The infiltrated air accumulates in the space between the gaskets 76 and 77, and the accumulated air gradually enters in small amounts the oil chamber 16 from the gasket 76 as the oil of the oil chamber 16 is pulled by the oil piston 2 and put under negative pressure in the return step of the nose piston 28. Thus air bubbles are formed in the oil of the oil chamber 16.

As shown in FIG. 9, an aircraft rivet has a washer R4 in addition to a shank R1, a rivet main body R2, and a head portion (flange body) R3. When the conventional continuous riveter is in use, the vacuum ejector 12 runs constantly in order to prevent the rivet R from dropping off of the nose piece 32 as well as to collect, in the shank storing case 9, the used shank R1 which has been cut (broken) off, upon completion of caulking. Accordingly, the washer R4 remains pressed against the front end of the nose piece 32 by suction as shown in FIG. 10 and hinders loading of the next rivet R. Thus, the riveter cannot be used until the washer R4 is removed, which makes it impossible to perform riveting in succession.

Although in some cases the guide plate 43 of the rivet supplying section F is bent as shown in FIGS. 31 through 34, caulking can not be performed in an accurate manner with a conventional rivet holder belt.

Therefore, a first object of the present invention is to provide a continuous riveter in which, between air chambers 4, 14, and 15 and the oil chambers 6 and 16 defined by an oil piston 2, a jaw case piston 20, and a nose piston 28, compressed air of the air chambers 4, 14, and 15 is prevented from entering the oil chambers 6 and 16, so that no air bubbles are formed in the oil to enable precise operations.

A second object of the present invention is to provide a continuous riveter in which, even when a vacuum ejector 12 is in operation and the suction force is acting on a nose piece 32, or an aircraft rivet R provided with a washer R4 is used, the washer R4 can be dislodged from the nose piece 32 without being pressed against the nose piece 32 by suction.

A third object of the present invention is to provide a continuous caulking method of rivets by using a rivet holder belt T with which accurate riveting can be performed with a continuous riveter that has a bent guide plate 43 in a rivet supplying section F.

DISCLOSURE OF THE INVENTION

In a continuous riveter of the present invention, an oil chamber side seal member and an air chamber side seal member are provided in the oil cylinder where the oil piston separates an oil chamber of the oil cylinder from an air chamber of an air cylinder, a portion of the oil cylinder which is between the seal members has an air vent; and an oil chamber side seal member and an air chamber side seal member are provided in the jaw case piston and in the nose piston, the seal members sealing an area between an oil chamber and an air chamber, and the pistons between the seal members each have an air vent.

With this, the air, which has entered, from the air chamber side, through the space between the oil chamber side seal member and the air chamber side seal member escapes through the air vent. Therefore, no air is accumulated in the space between the seal members and infiltration of air into the oil chamber is avoided.

Further, according to a continuous riveter of the present invention, the continuous riveter includes a rivet supplying section that has a storage case and a tape air cylinder, the storage case storing a blind rivet holder belt wound into a loop, the blind rivet holder being loaded with blind rivets, and the tape air cylinder guiding the blind rivet holder belt along a guide plate to supply the blind rivets, which are loaded in the blind rivet holder belt, one by one, in which:

the guide plate extended from the storage case of the rivet supplying section has a linear feed portion of a predetermined length and a bent portion which is continuous from the linear feed portion and where a vertical portion of the blind rivet holder belt is bent at a predetermined angle;

a pressing plate that extends over a guide surface from the linear feed portion to the bent portion of the guide plate to guide the blind rivet holder belt while pressing down on the vertical portion of the blind rivet holder belt, the pressing plate guiding, from the linear feed portion to the bent portion, the blind rivet holder belt that has been fed linearly by a feed claw to bend the blind rivet holder, the feed claw making a linear reciprocating motion due to the tape air cylinder; and a tubular body of the nose piston is positioned on the axial center of a shank of a blind rivet held by an upper tab and a lower tab which are situated immediately past the bent portion where the blind rivet holder belt is bent after passing the linear feed portion of the guide plate, the axial center of the shank and the axial center of the tubular body coinciding with each other.

This adds another effect to the one described above. Since the bent portion of the guide plate is provided with the pressing plate for guiding the blind rivet holder belt by pressing on the vertical portion of the blind rivet holder belt, the rivet holder belt that has been sent forward linearly is securely bent along the bent portion of the guide plate and the gap between the preceding pair of upper and lower tabs and the subsequent pair of upper and lower tabs is increased without fail. As a result, the interval (pitch) between one rivet R and another rivet R in the rivet holder belt T can be reduced. Therefore, the number of rivets R loaded per a given length of the rivet holder belt T can be increased and more rivets can be stored in the storage case 47 than in the prior art.

Further, according to the continuous riveter of the present invention, an insertion hole in which a shank of a blind rivet is inserted is drilled in the nose piece on the front end of the tubular body of the nose piston, and plural suction-force dispersing holes communicated with the insertion hole are drilled in the nose piece from an outer circumferential face of the nose piece.

With this, even when a vacuum ejector is constantly in operation to exert a suction force over the nose piece portion, the suction force dispersing holes serve to disperse and reduce the suction force as a shank of a rivet is removed, thereby allowing the washer R4 to fall off.

Further, according to the present invention, there is provided a continuous caulking method of blind rivets, in which a specific blind rivet holder belt is loaded in a specific continuous riveter in riveting for caulking, the continuous riveter including:

a rivet supplying section that has a storage case and a tape air cylinder, the storage case storing the blind rivet holder belt wound into a loop, the blind rivet holder being loaded with blind rivets, the tape air cylinder guiding the blind rivet holder belt along a guide plate to supply the blind rivets of the blind rivet holder belt one by one, the guide plate being extended from the storage case of the rivet supplying section, the guide plate having a linear feed portion of a predetermined length and a bent portion which is continuous from the linear feed portion and where a direction of a vertical portion of the rivet holder belt is bent at a predetermined angle;

a pressing plate which extends over a guide surface from the linear feed portion to the bent portion of the guide plate to guide the blind rivet holder belt by pressing down on the vertical portion of the blind rivet holder belt; and a feed claw that is put into a linear reciprocating motion due to the tape air cylinder to linearly feed the blind rivet holder belt, which is then guided by the pressing plate from the linear feed portion to the bent portion to be bent, the continuous riveter positioning the tubular body of the nose piston on the axial center of a shank of a blind rivet held by an upper tab and a lower tab which are situated immediately past the bent portion where the blind rivet holder belt is bent after passing the linear feed portion of the guide plate, the axial center of the shank and the axial center of the tubular body coinciding with each other, the blind rivet holder belt including:

an elongated body shaped like a mirror image of a letter C, a vertical portion of the elongated body having upper tabs and lower tabs along its upper and lower edges at minute regular intervals, one tab and its adjacent tab being separated from each other by a narrow cut;

feed holes formed in the vertical portion to send the elongated body in a fixed direction;

a first through hole formed in each of the upper tabs to hold a shank of a blind rivet that is inserted through the first through hole; and a second through hole formed in each of the lower tabs to hold a rivet main body of a blind rivet that is inserted through the second through hole with a head portion of the rivet main body resting against an inner face of the lower tab, the upper tabs and the lower tabs being horizontally staggered in a longitudinal direction of the vertical portion, the first and second through holes being slanted at an angle that is adjusted to an outer circumference of the shank and the rivet main body of the blind rivet inserted obliquely, cuts between the upper tabs and cuts between the lower tabs are being connected by oblique fold lines formed on an inner face of the vertical portion.

This method enables caulking to be performed in an efficient, accurate manner by using a rivet holder belt with an increased number of rivets loaded per unit length of the rivet holder belt.

BRIEF DESCRIPTION OF THE DRAWINGS

FIGS. 1 and 2 show the whole.

FIGS. 12 and 13 show the whole.

FIGS. 14 and 15 show the whole.

BEST MODE FOR CARRYING OUT THE INVENTION

More detailed descriptions of the present invention are given with reference to the accompanying drawings.

Figure 1:
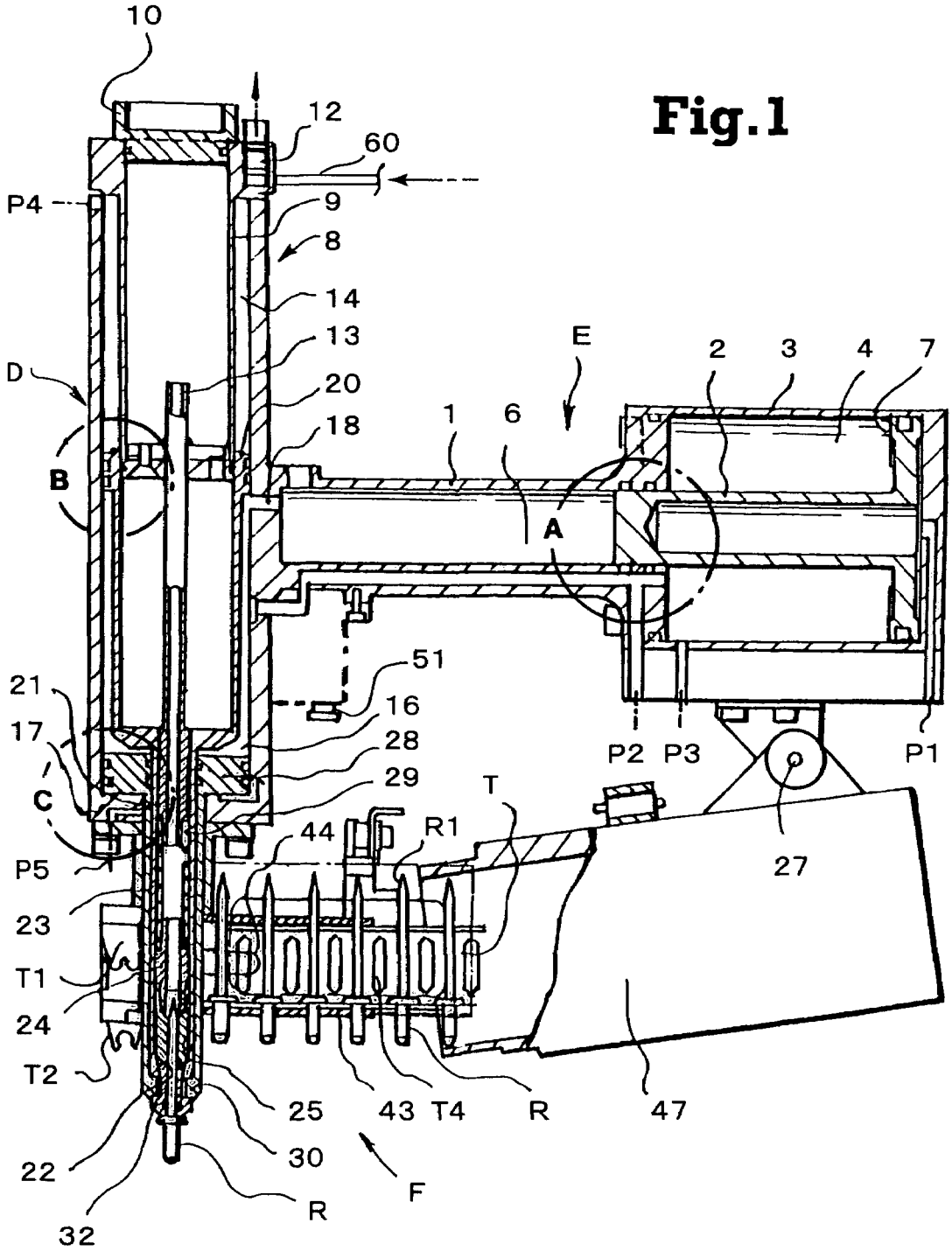
FIG. 1 is a sectional view showing an embodiment of the present invention.
Figure 2:
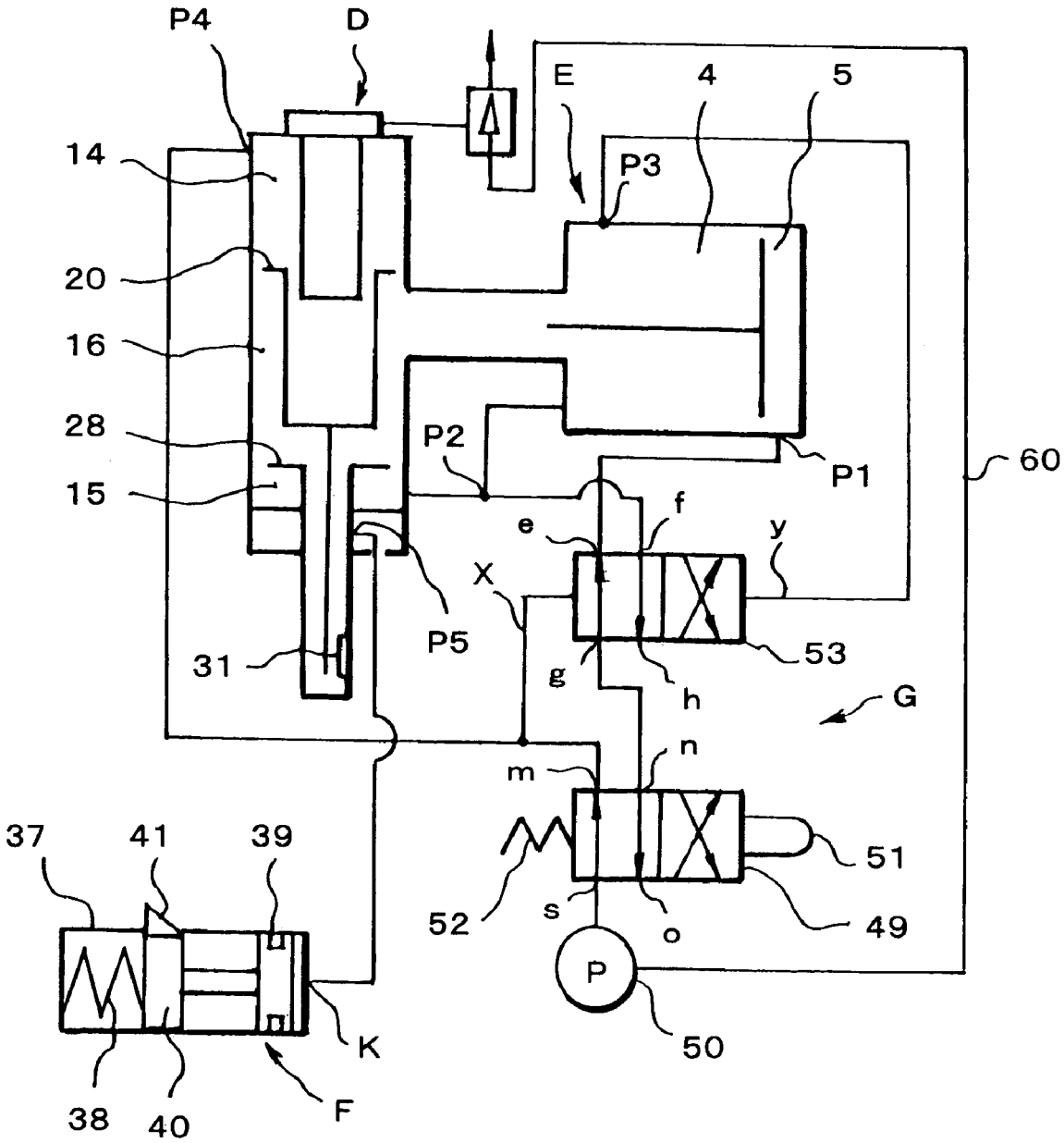
FIG. 2 is a circuit diagram of an embodiment of the present invention. Combined.
Figure 3:
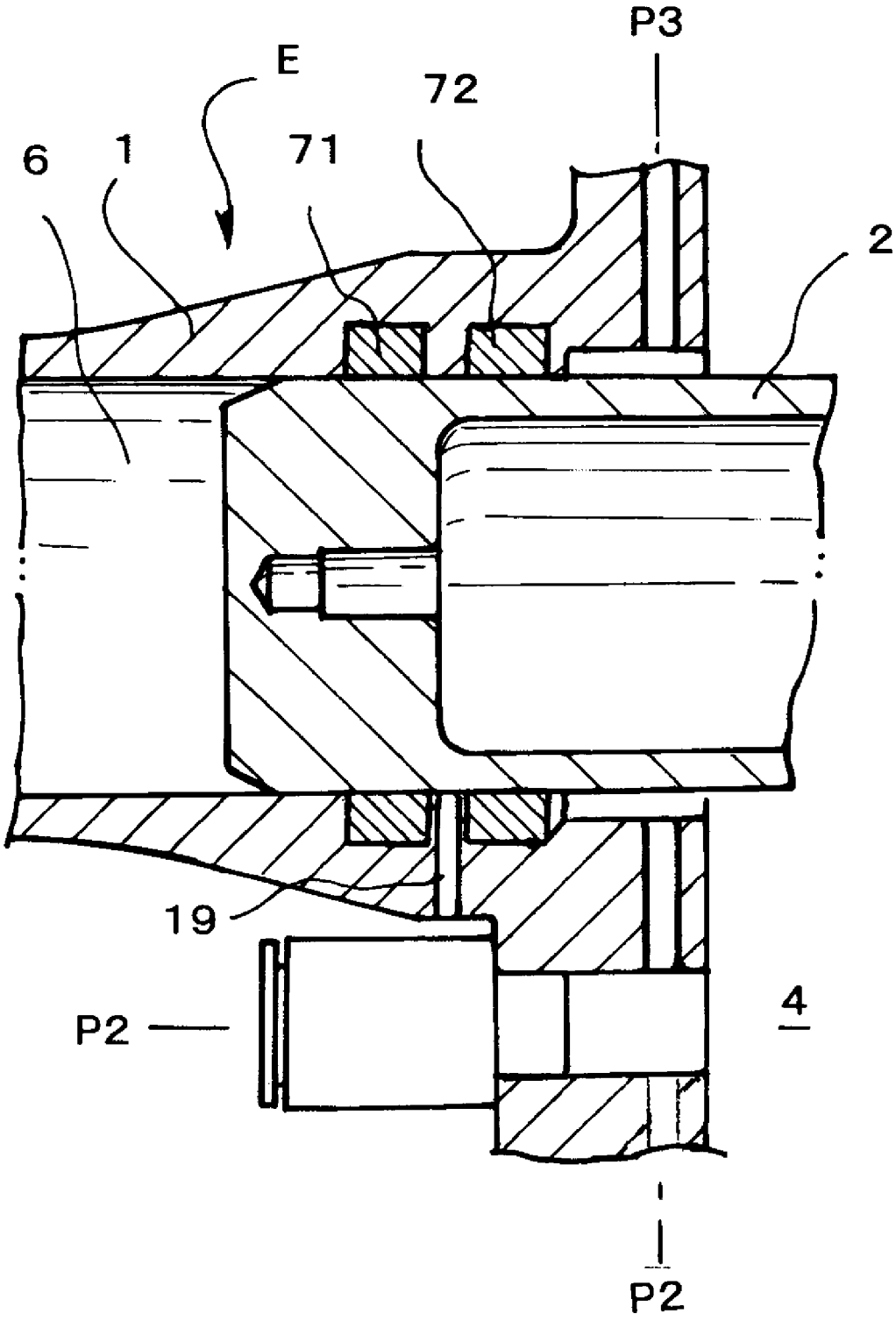
FIG. 3 is an enlarged view of a portion A of FIG. 1.
Figure 4:
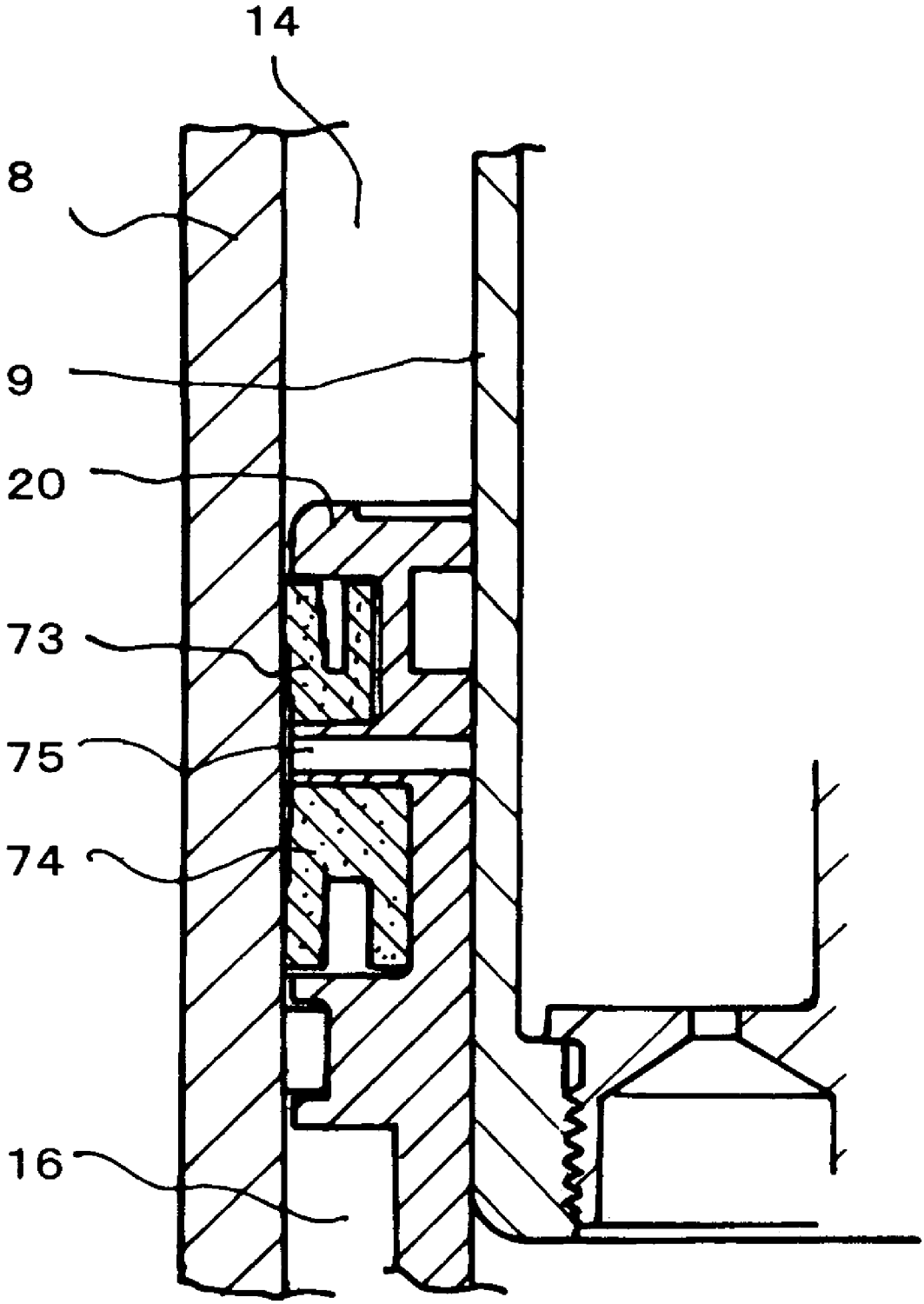
FIG. 4 is an enlarged view of a portion B of FIG. 1.
Figure 5:
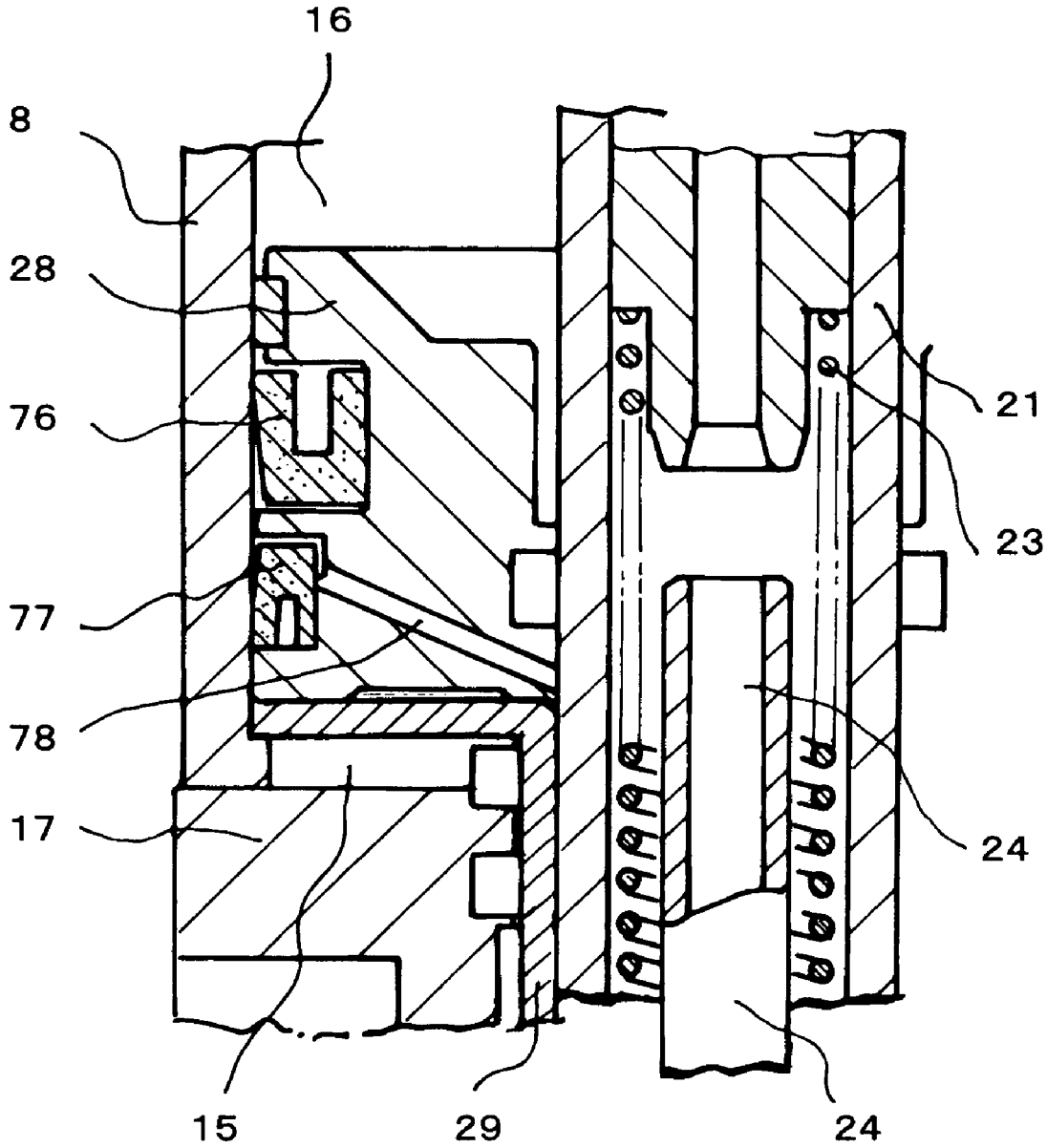
FIG. 5 is an enlarged view of a portion C of FIG. 1.

FIG. 1 is a sectional view showing an embodiment of the present invention. FIG. 2 is a circuit diagram of an embodiment of the present invention. Combined, FIGS. 1 and 2 show the whole. FIG. 3 is an enlarged view of a portion A of FIG. 1. FIG. 4 is an enlarged view of a portion B of FIG. 1. FIG. 5 is an enlarged view of a portion C of FIG. 1. Structural components that are identical with those in the above-described examples of prior art are denoted by the same reference symbols. While detailed descriptions of such components are omitted, characteristic structures of the present invention are described in detail.

A chuck cylinder 8 has a small-diameter oil cylinder 1 which is branched and extended sideways and a large-diameter air cylinder 3 which drives an oil piston 2 of the oil cylinder 1. The oil piston 2 serves as a piston rod of a piston 7 installed in the air cylinder 3, and the oil piston 2 and the piston 7 are integrally coupled to each other. The oil cylinder 1 is communicated with a chuck cylinder 8 through a hole 18 leading to an oil chamber 16, which is a space created between a jaw case piston 20 and a nose piston 28 in the chuck cylinder 8. The oil piston 2 serves to define an oil chamber 6 of the oil cylinder 1 and an air chamber 4 of the air cylinder 3. As shown in FIG. 3, the oil cylinder 1 is provided with a seal member 71 located on the oil chamber 6 side and a seal member 72 located on the air chamber 4 side. A portion of the oil cylinder 1 which is between the seal members 71 and 72 has an air vent 19.

Further, within the chunk cylinder 8, a jaw case piston 20 is slidably inserted to separate an air chamber 14 above the jaw case piston 20 from an oil chamber 16 below the jaw case piston 20. Below the jaw case piston 20, the nose piston 28 is slidably inserted to separate the oil chamber 16 above the nose piston 28 from an air chamber 15 below the nose piston 28. A tubular body 29 extending to the outside of the chuck cylinder 8 is fixedly attached to the bottom of the nose piston 28. A tubular jaw case 21 moving up and down in the tubular body 29 is fixedly attached to the jaw case piston 20.

As shown in FIG. 4, a seal member 73 located on the air chamber 14 side and a seal member 74 located on the oil chamber 16 side are provided in the jaw case piston 20, the seal members 73 and 74 sealing an area between the air chamber 14 and the oil chamber 16. An air vent 75 is provided in each of the pistons 20 between the seal members 73 and 74.

Further, as shown in FIG. 5, a seal member 76 located on the oil chamber 16 side and a seal member 77 located on the air chamber 15 side are provided in the nose piston 28, the seal members 76 and 77 sealing an area between the oil chamber 16 and the air chamber 15. An air vent 78 is provided in each of the pistons 28 between the seal members 76 and 77.

Therefore, if compressed air on the air chamber 4 side of the air cylinder 3 enters, from the side of the seal member 72, the portion of the oil cylinder 1 which is between the seal members 71 and 72, the compressed air escapes from the air vent 19 to the outside (into the atmosphere). This prevents the pressure in the space between the seal members 71 and 72 from rising higher than the atmospheric pressure and no air is accumulated between the seal members 71 and 72. Since infiltration of air into the oil chamber 6 of the oil cylinder 1 from the seal member 71 portion is prevented, no air bubbles are formed in the oil of the oil chamber 6 and reliable operation is ensured.

Further, even if compressed air enters the air chamber 14 side of the chuck cylinder 8 from the seal member 73 side, between the seal members 73 and 74 of the jaw case piston 20, the compressed air escapes from the air vent 75 to the outside. This prevents the pressure in the space between the seal members 73 and 74 from rising higher than the atmospheric pressure and no air is accumulated between the seal members 73 and 74. Thus, infiltration of air into the oil chamber 16 from the seal member 74 portion is prevented.

Furthermore, if compressed air of the air chamber 15 enters, from the side of the seal member 77, the portion of the nose piston 28 which is between the seal members 76 and 77, the compressed air escapes from the air vent 78 to the outside. This prevents the pressure in the space between the seal members 76 and 77 from rising higher than the atmospheric pressure and no air is accumulated between the seal members 76 and 77. Thus, infiltration of air into the oil chamber 16 from the side of the seal member 76 is prevented.

In this way, air is prevented from mixing in the oil of the oil chamber 16 and no air bubbles are formed, thus ensuring reliable operation.

Figure 6:
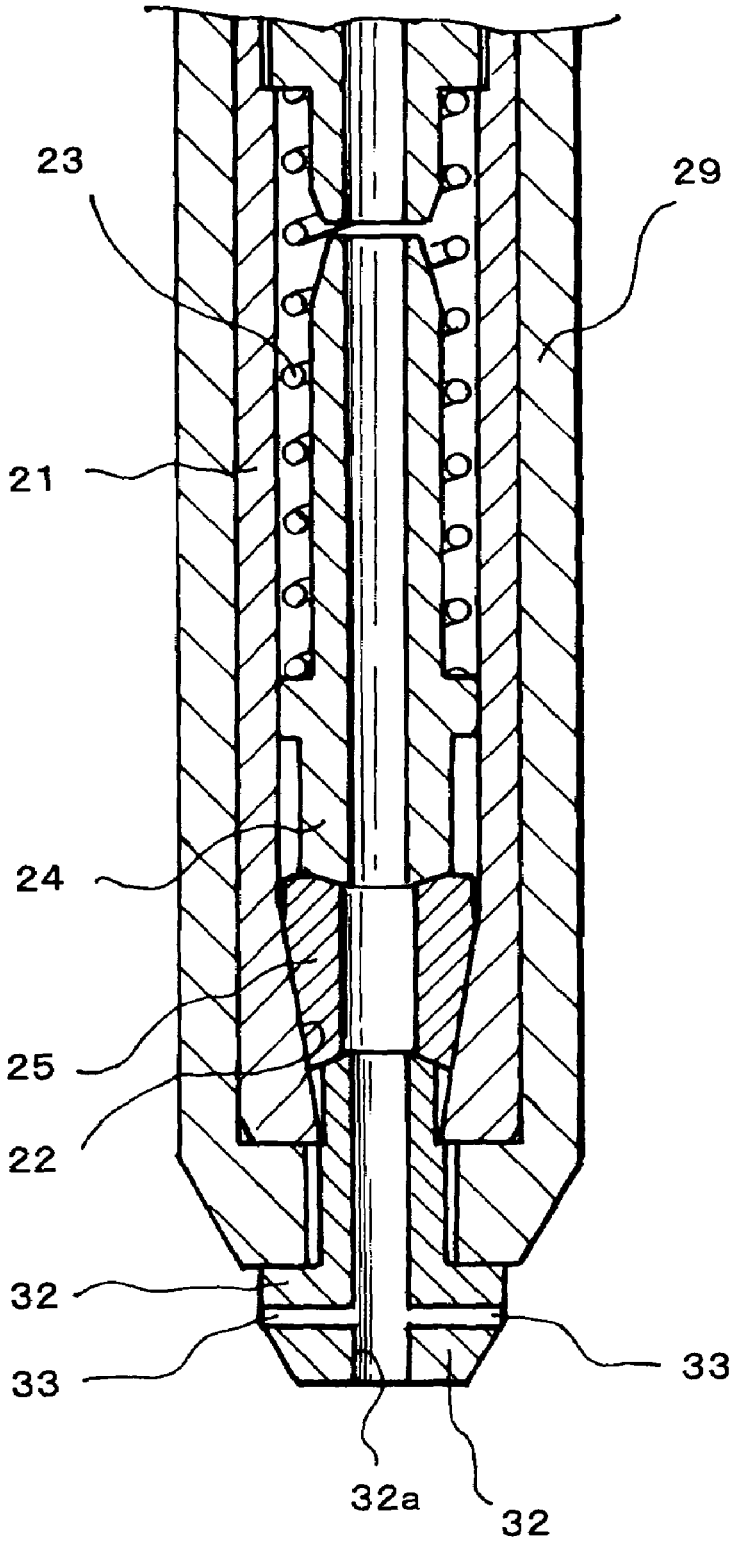
FIG. 6 is an enlarged sectional view of a nose piece portion.
Figure 7:
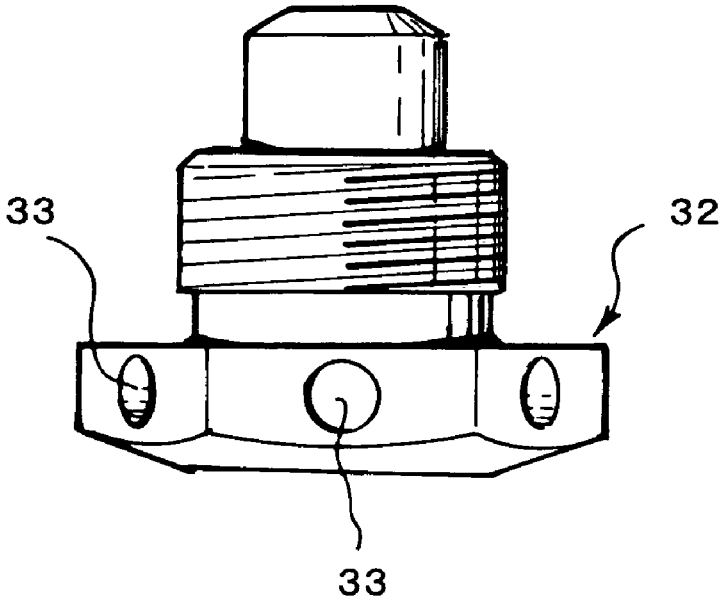
FIG. 7 is a frontal view showing an example of the nose piece.
Figure 8:
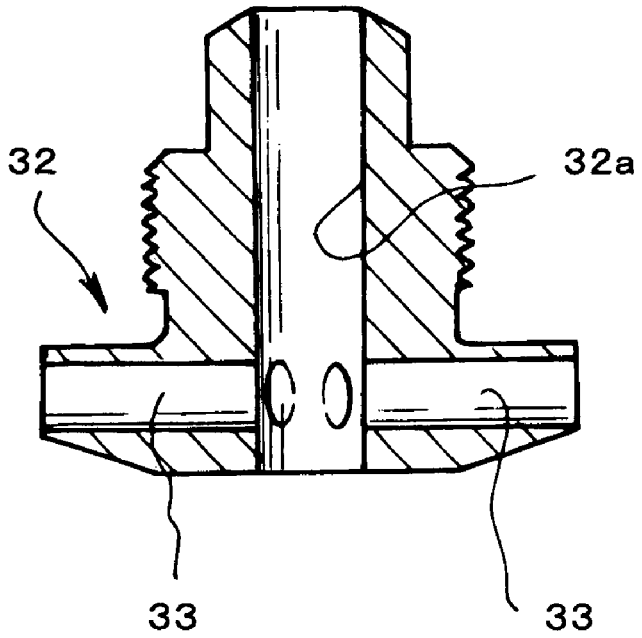
FIG. 8 is a sectional view of the nose piece.

FIG. 6 is an enlarged sectional view of a nose piece portion. FIG. 7 is a frontal view of the nose piece. FIG. 8 is a sectional view of the nose piece. As shown in FIGS. 6 through 8, a nose piece 32 of the present invention has plural suction-force dispersing holes 33 drilled from the outer circumferential face. The suction force dispersing holes 33 are communicated with an insertion hole 32*a* into which a shank R1 of a rivet R is inserted.

Figure 9:
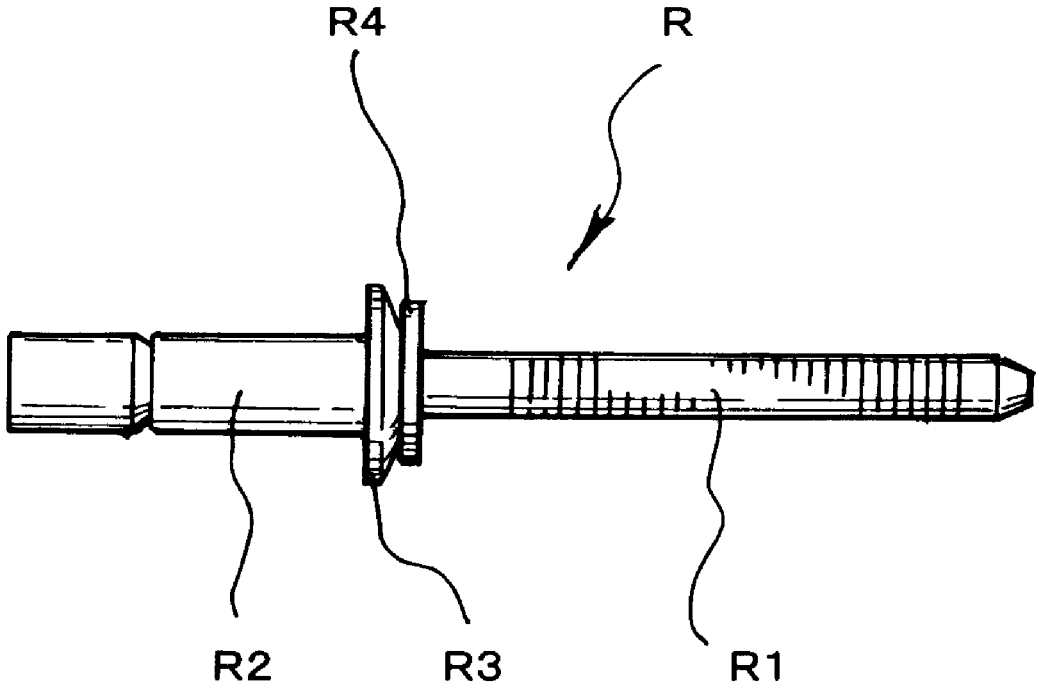
FIG. 9 is a frontal view of an aircraft rivet.
Figure 10:
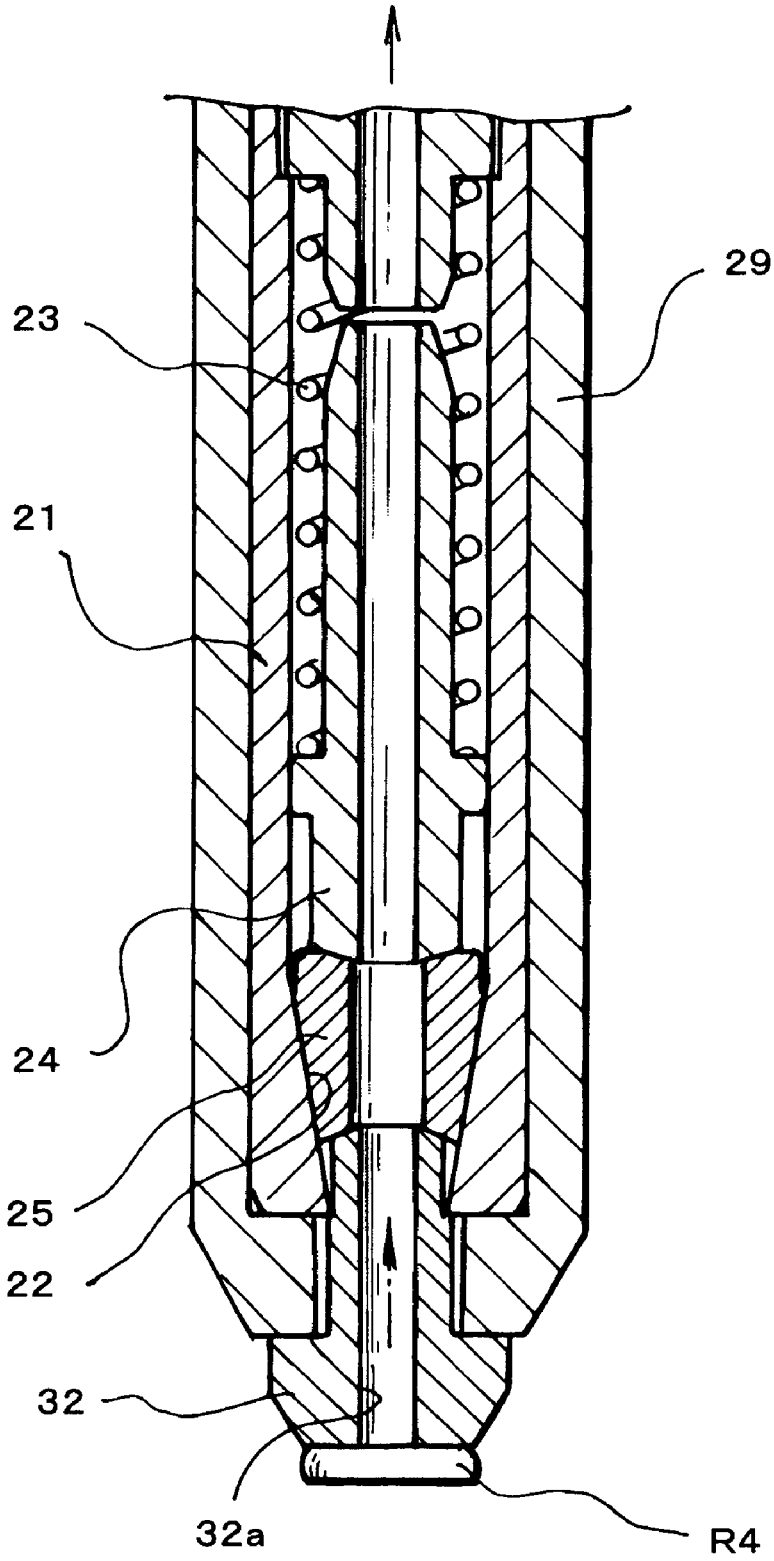
FIG. 10 is a sectional view showing a conventional example of a nose piece portion in the case where an aircraft rivet is used.

Therefore, as the shank R1 of the rivet R is inserted into the insertion hole 32*a* of the nose piece 32, the suction force dispersing holes 33 are blocked by the shank R1 to allow a vacuum ejector 12 to exert its suction force. When caulking is finished and the shank R1 is cut off to be collected in a shank storing case 9, the suction force dispersing holes 33 are opened so that the suction force of the vacuum ejector 12 is dispersed to lower the suction force acting on the nose piece 32. In this way, even if the vacuum ejector 12 is constantly in operation or an aircraft rivet R (see FIG. 9) having a washer R4 is used, the suction force dispersing holes 33 serve to disperse and lower the suction force upon completion of caulking. Accordingly, the washer R4 is dropped off without fail unlike in the prior art shown in FIG. 10 where the washer R4 remains attached by suction to the front end of the nose piece 32. In addition, the rivet R is securely held in the nose piece 32 portion by a suction force, and the shank that is cut off of the rivet R after completion of caulking is collected in the shank storing case 9.

Figure 11:
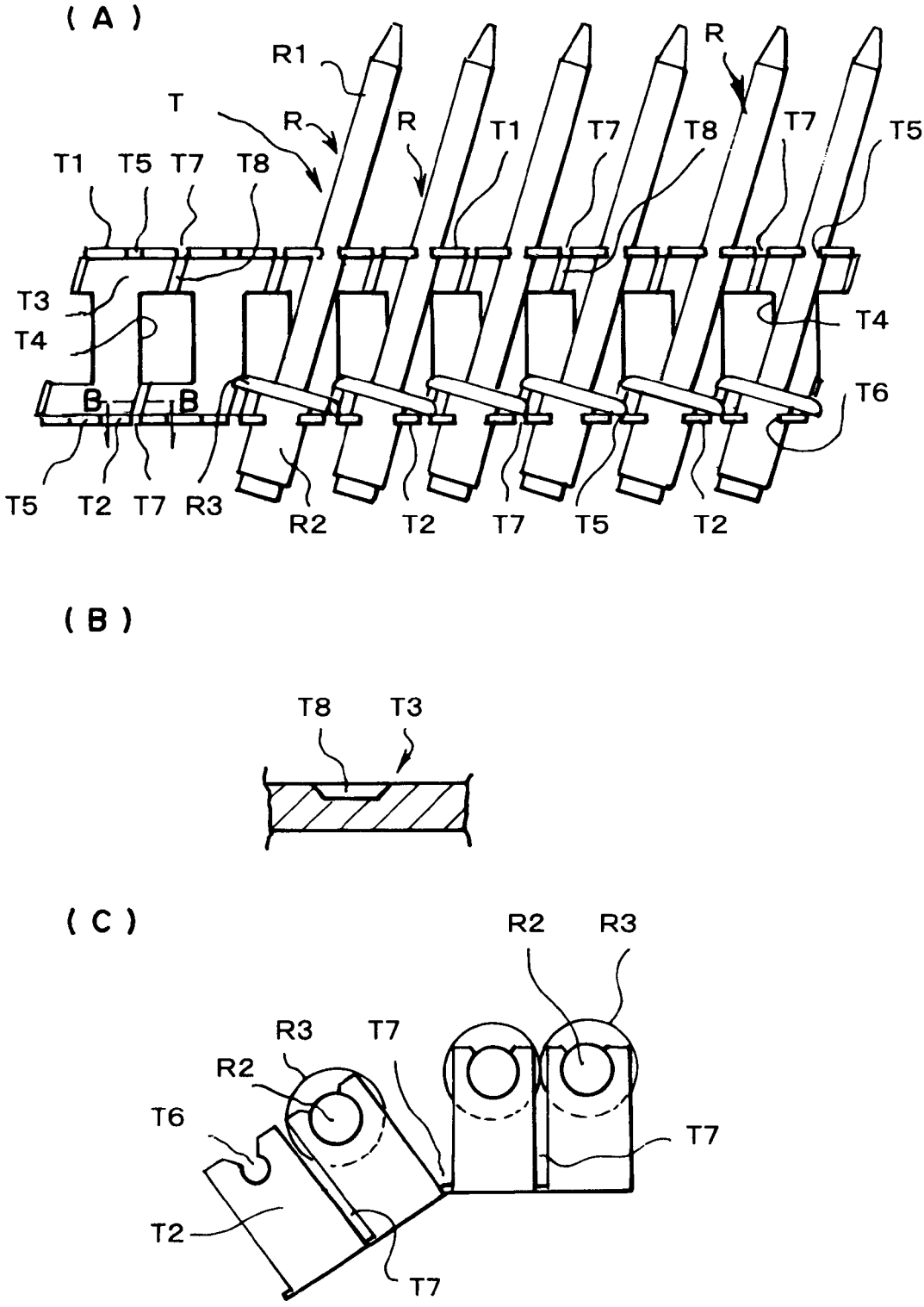
FIG. 11(A) is a frontal view of a rivet holder belt.
FIG. 11(B) is a sectional view taken along the line B—B of FIG. 11(A)
FIG. 11(C) is a bottom view.
Figure 12:
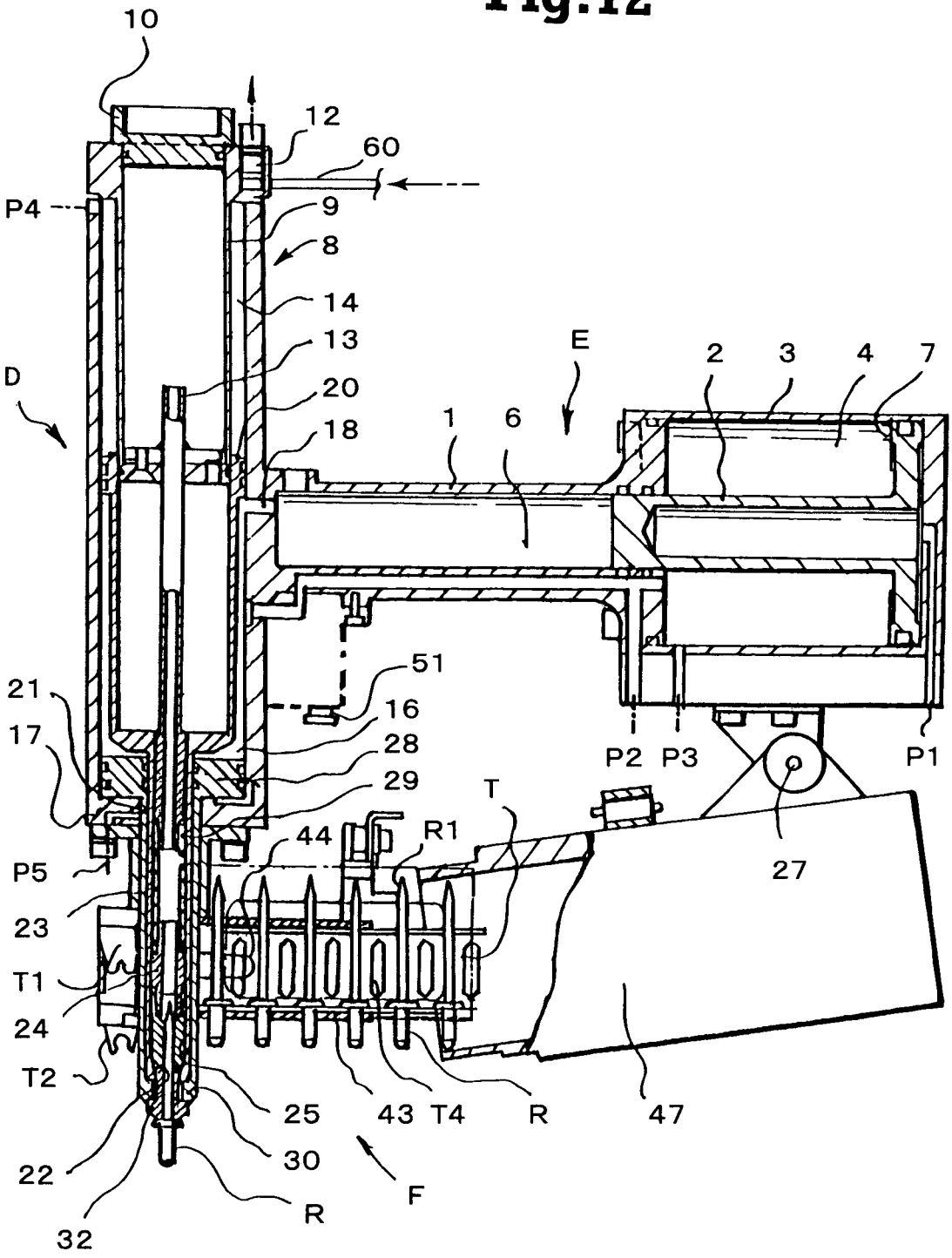
FIG. 12 is a sectional view showing a conventional continuous riveter with a push button, which is attached to the continuous riveter, released to put a trigger valve and an operation valve into their normal positions.
Figure 13:
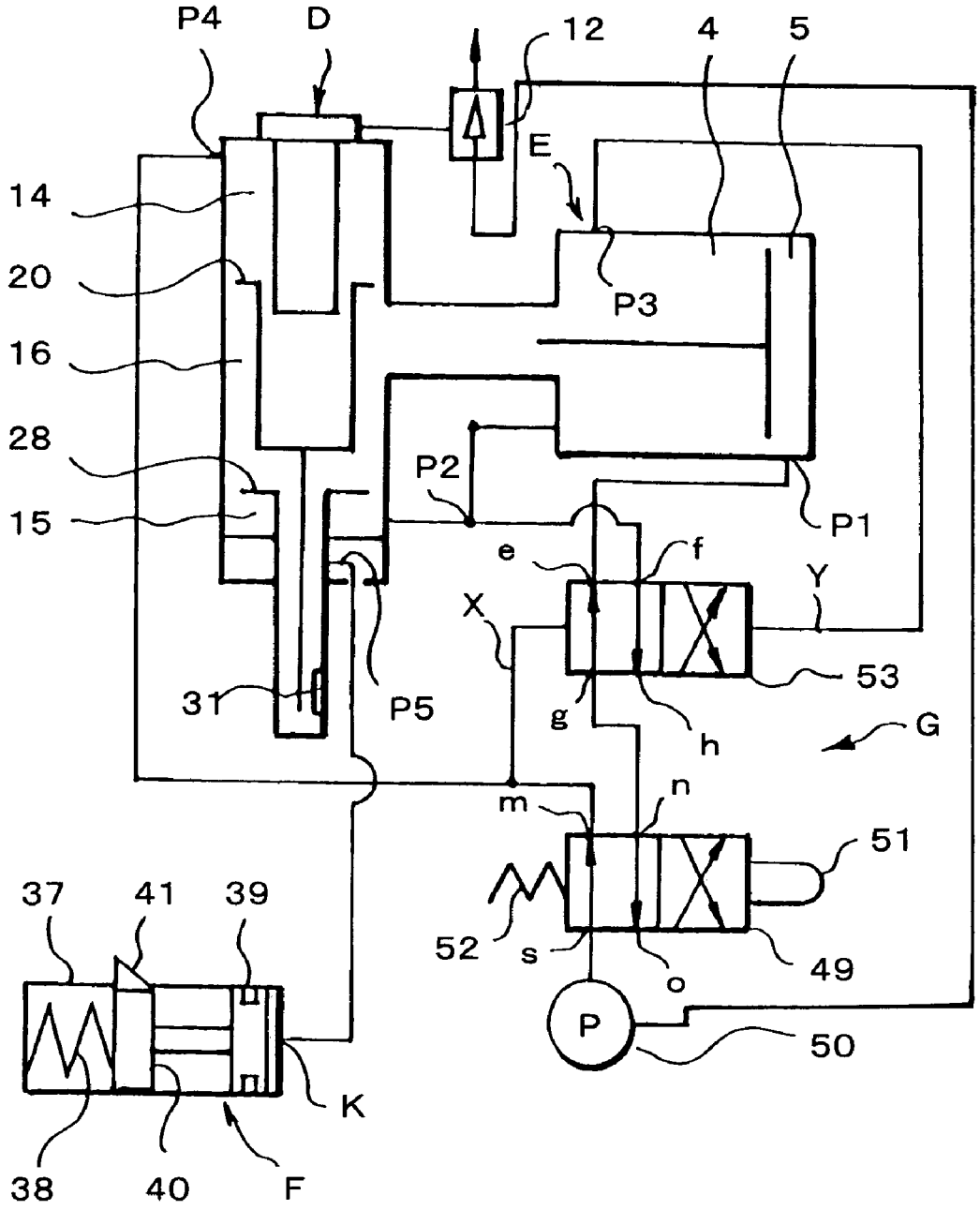
FIG. 13 is a valve circuit diagram showing the conventional continuous riveter. Combined.
Figure 14:
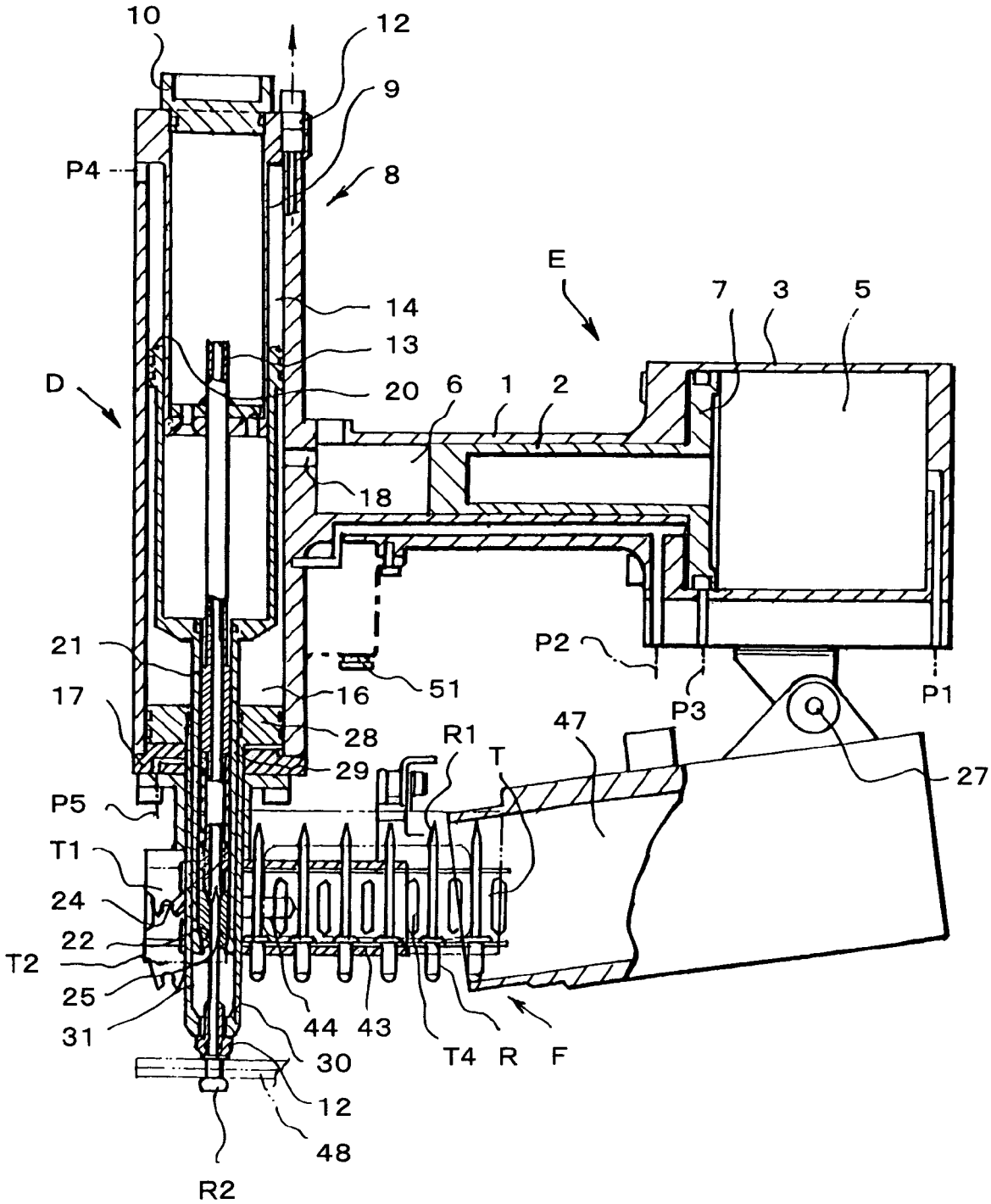
FIG. 14 is a sectional view showing the conventional continuous riveter with the push button, which is attached to the continuous riveter, pushed to switch the trigger valve alone.
Figure 15:
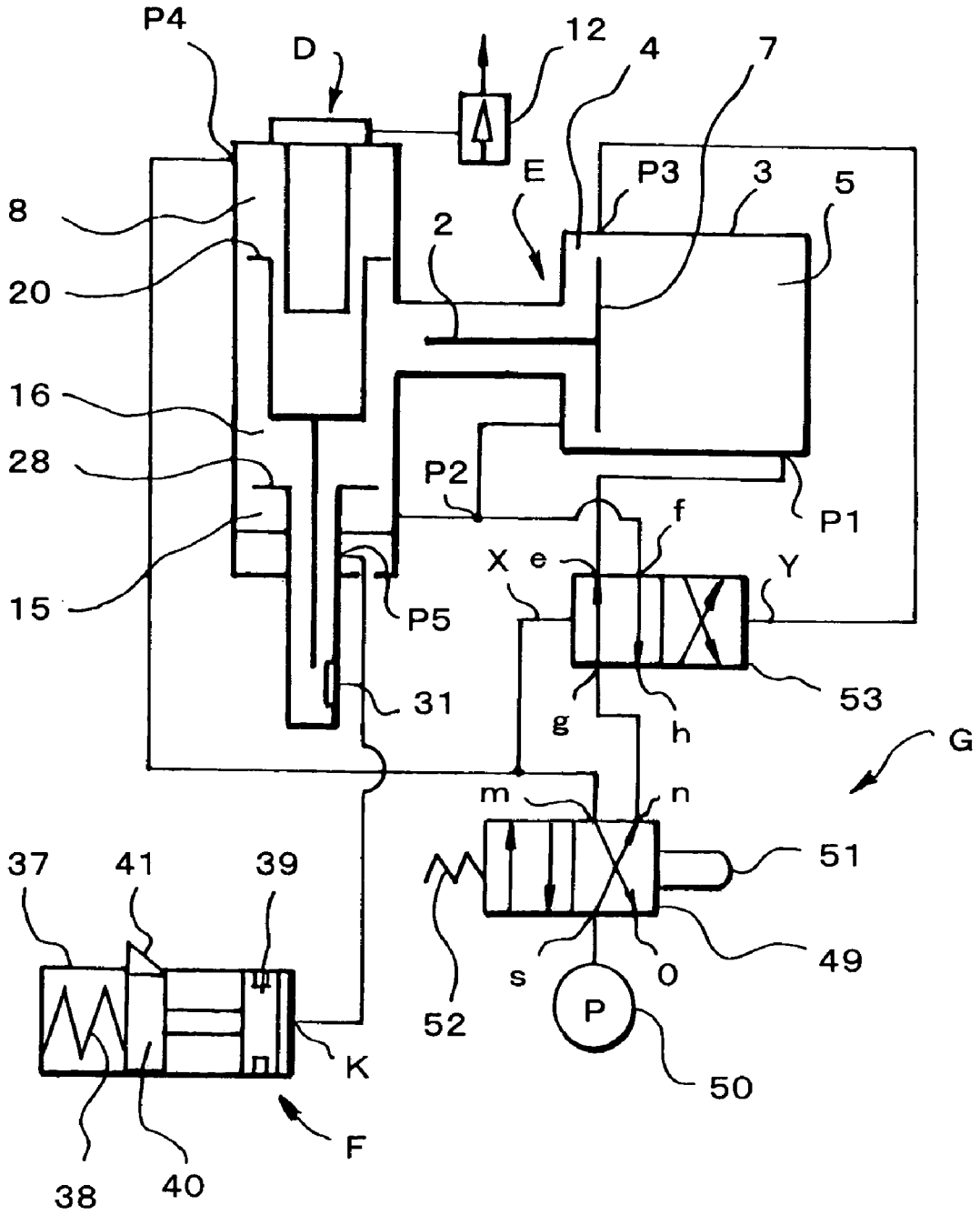
FIG. 15 is a valve circuit diagram showing the conventional continuous riveter. Combined.
Figure 16:
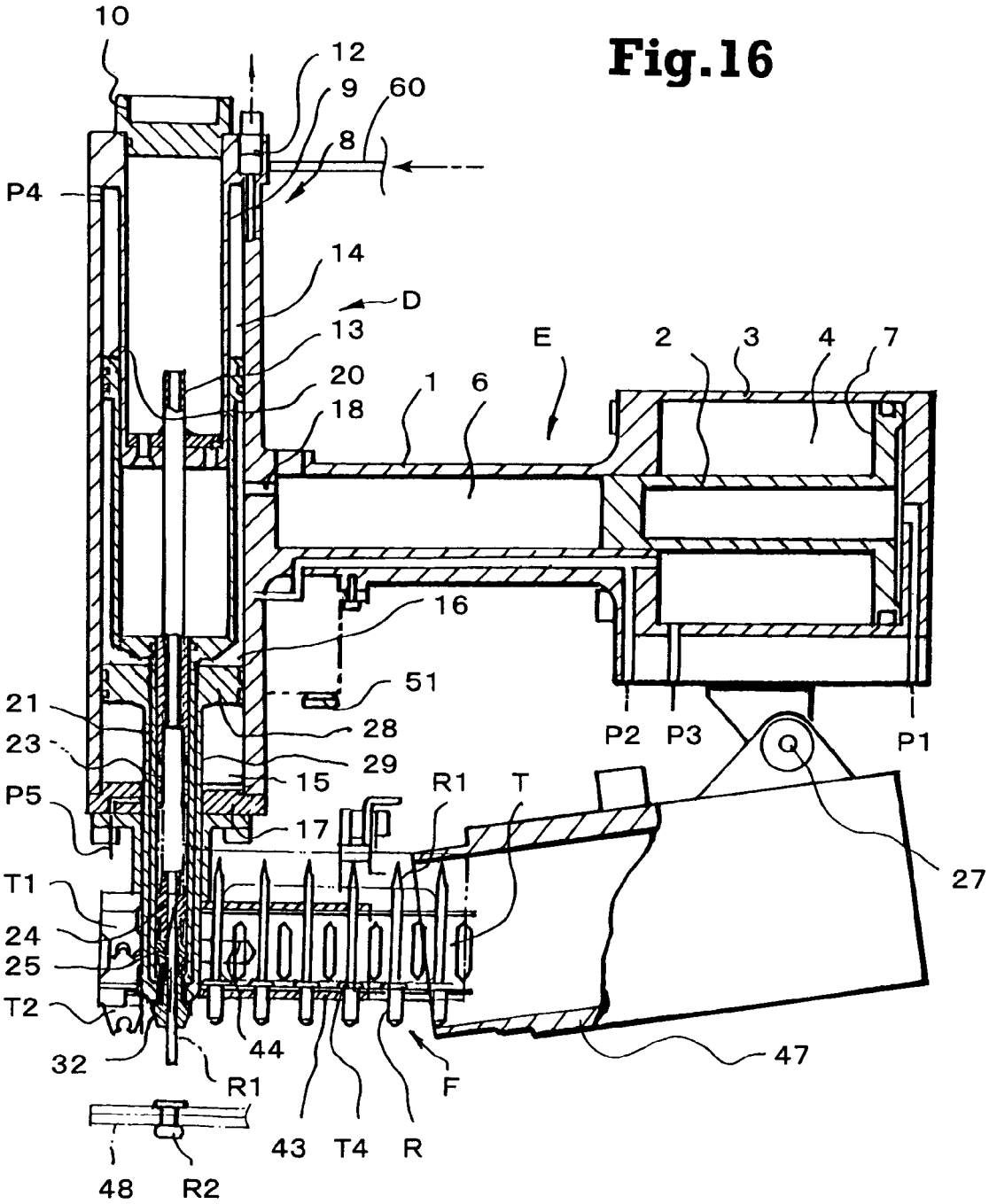
FIG. 16 is a sectional view showing the conventional continuous riveter with the push button, which is attached to the continuous riveter, pushed to switch both the trigger valve and the operation valve.
Figure 17:
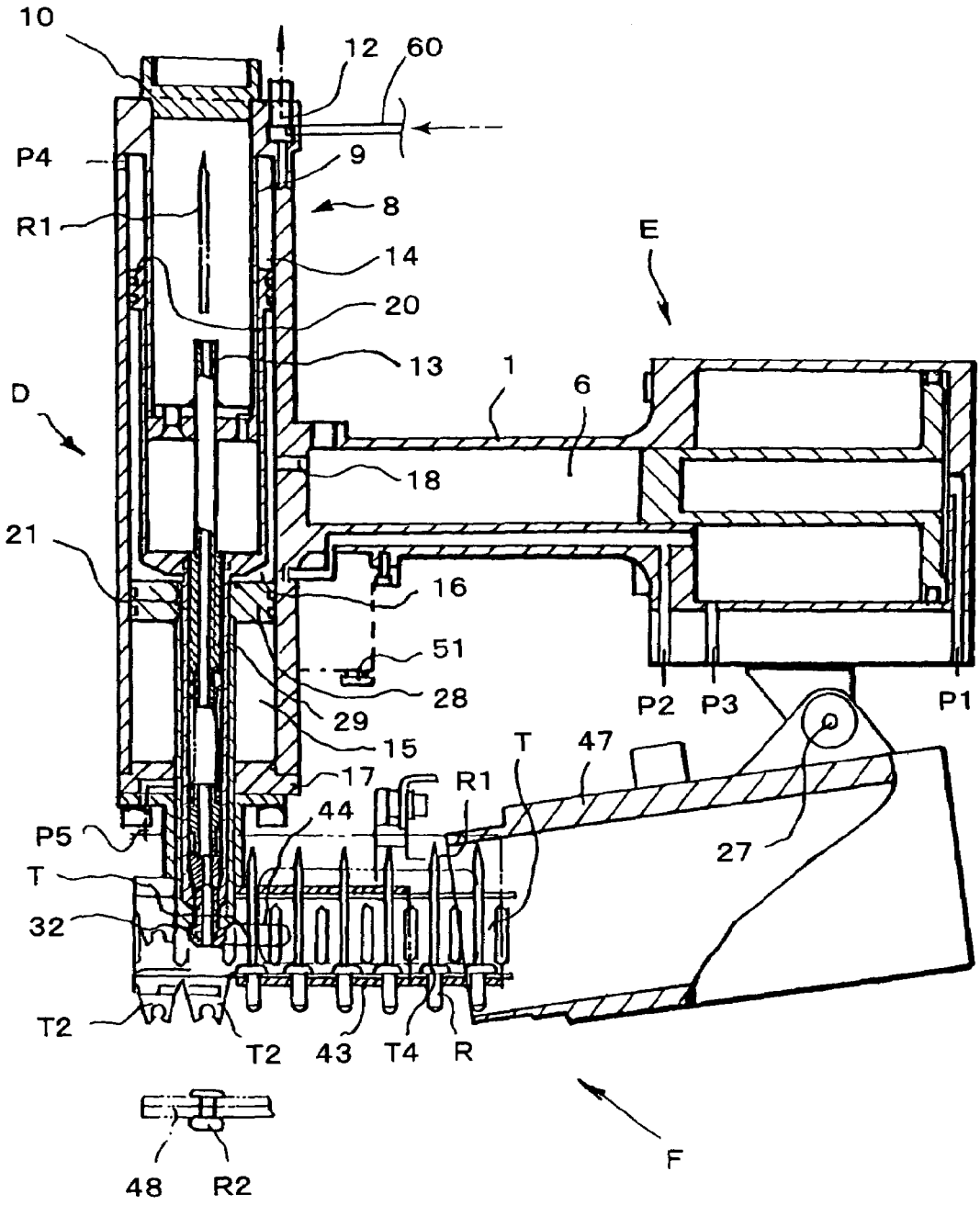
FIG. 17 is a sectional view showing the conventional continuous riveter with the push button, which is attached to the continuous riveter, pushed to switch both the trigger valve and the operation valve.
Figure 18:
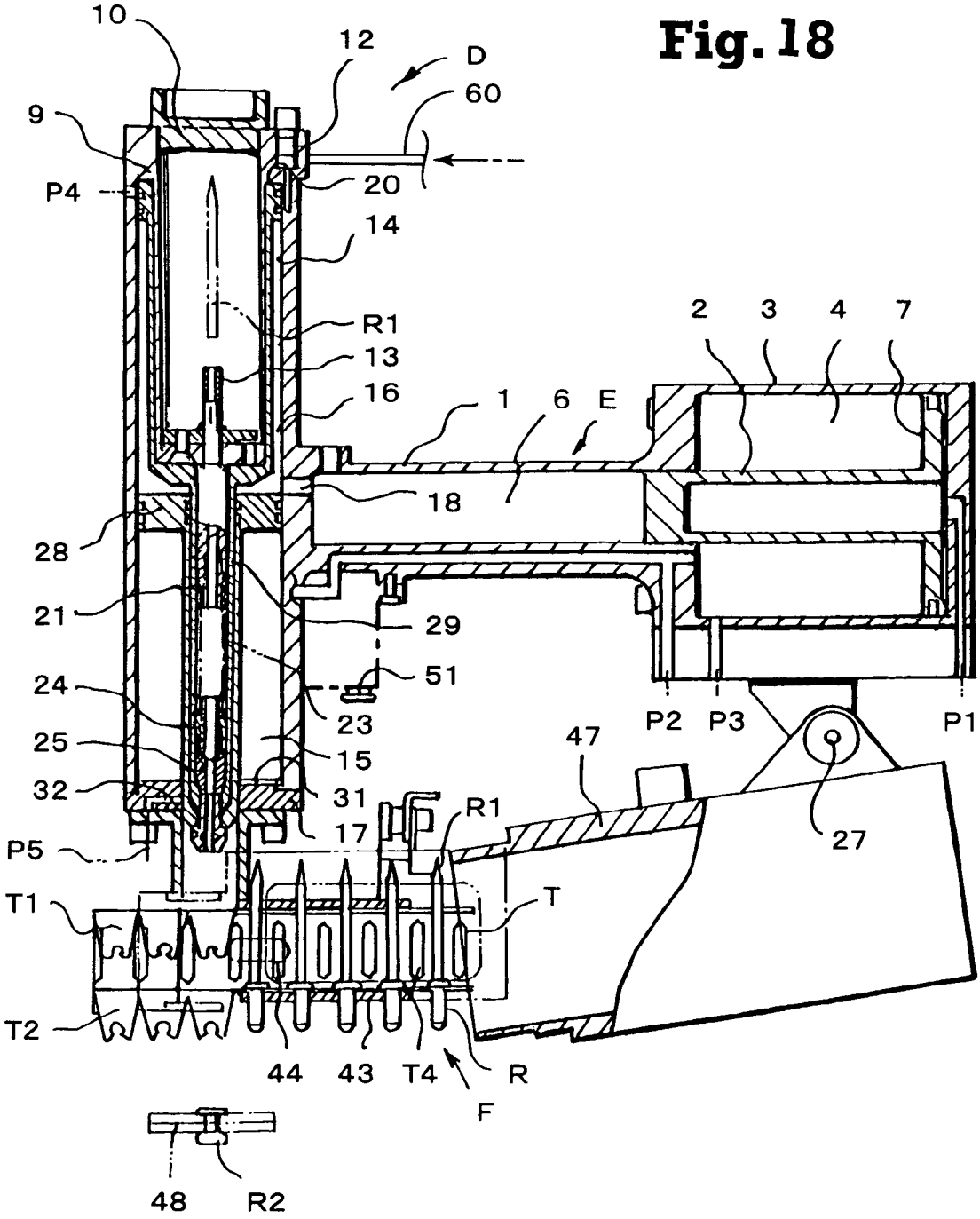
FIG. 18 is a sectional view showing the conventional continuous riveter with the push button, which is attached to the continuous riveter, pushed to switch both the trigger valve and the operation valve.
Figure 19:
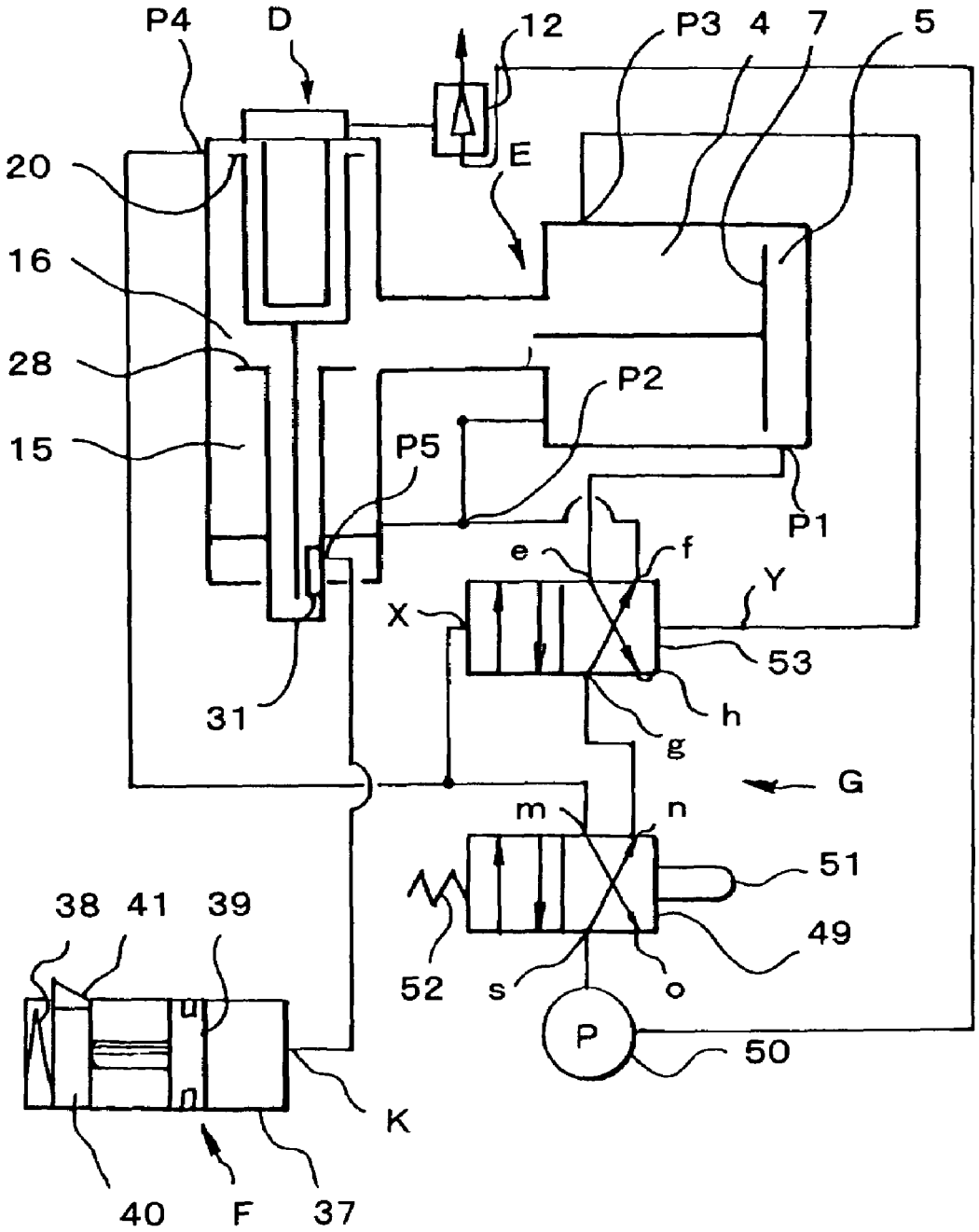
FIG. 19 is a valve circuit diagram of when the conventional continuous riveter is in the states shown in FIGS. 16 through 18.
Figure 20:
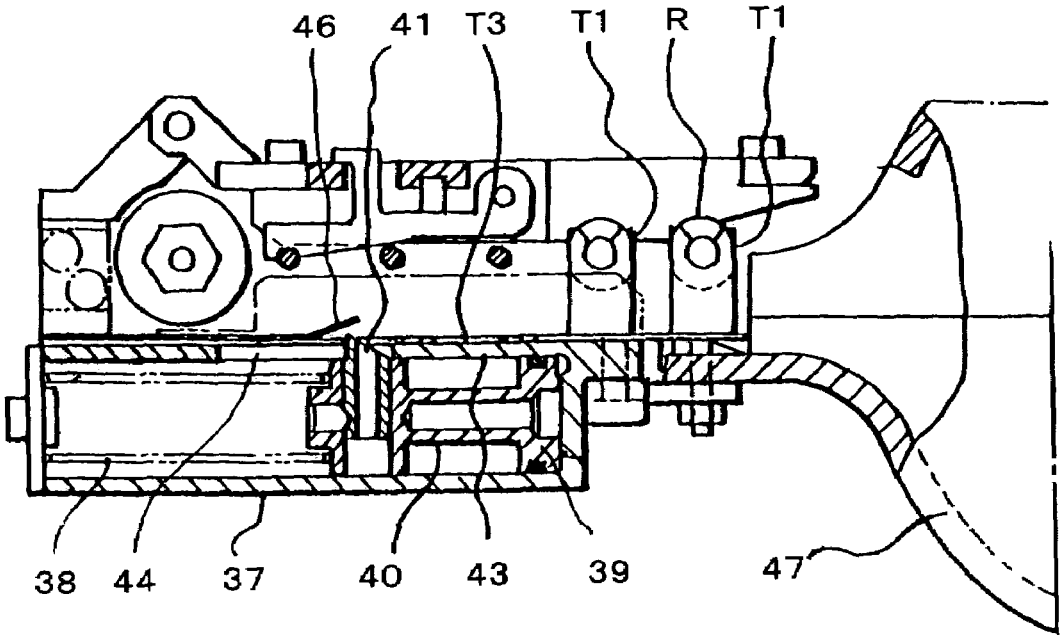
FIG. 20 is a cross-sectional view of a rivet supplying section.
Figure 21:
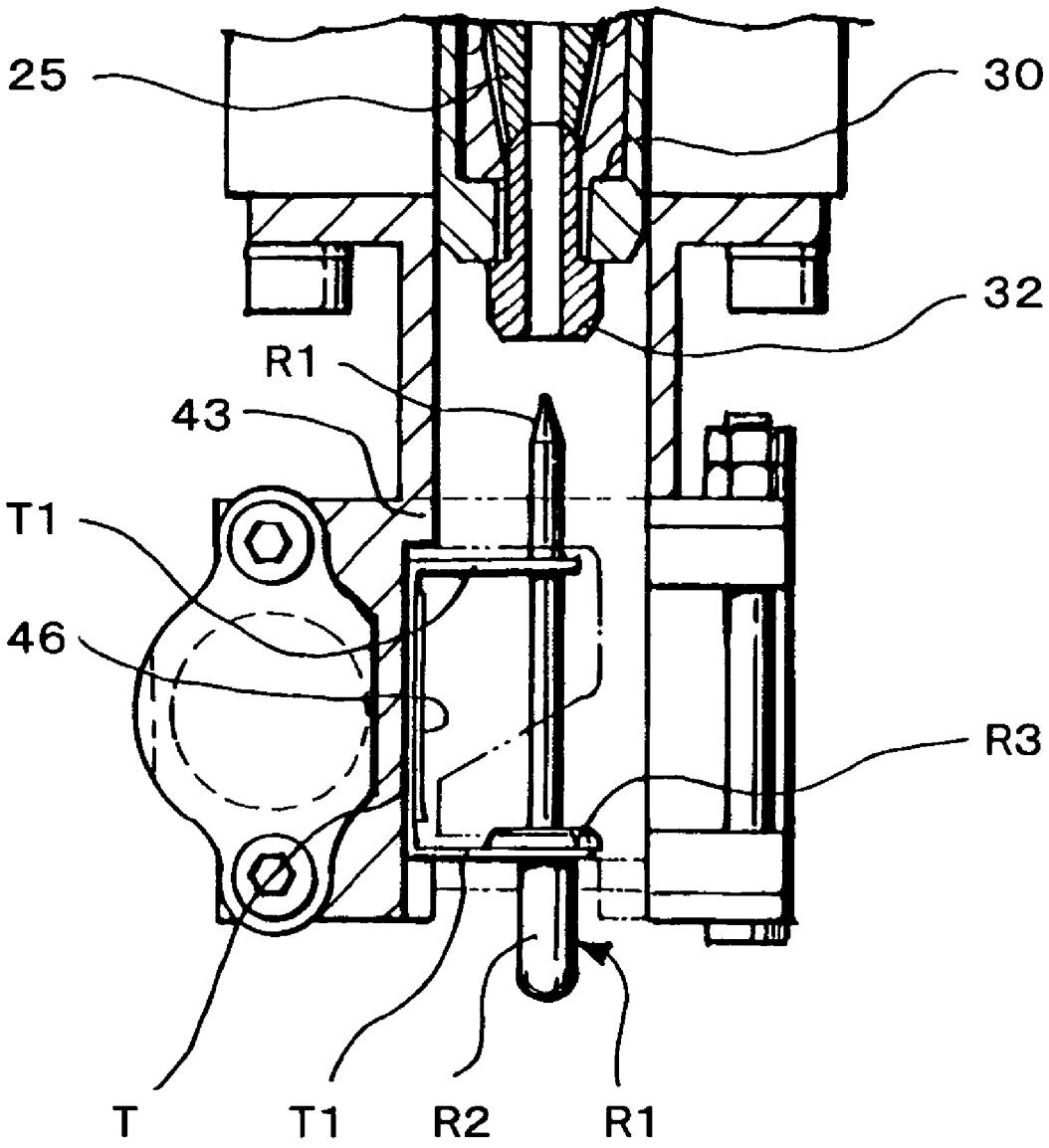
FIG. 21 is a frontal view of the conventional continuous riveter with the rivet supplying section partially cut off to show the relation between the nose piece and a blind rivet holder belt during descent of the nose piece.
Figure 22:
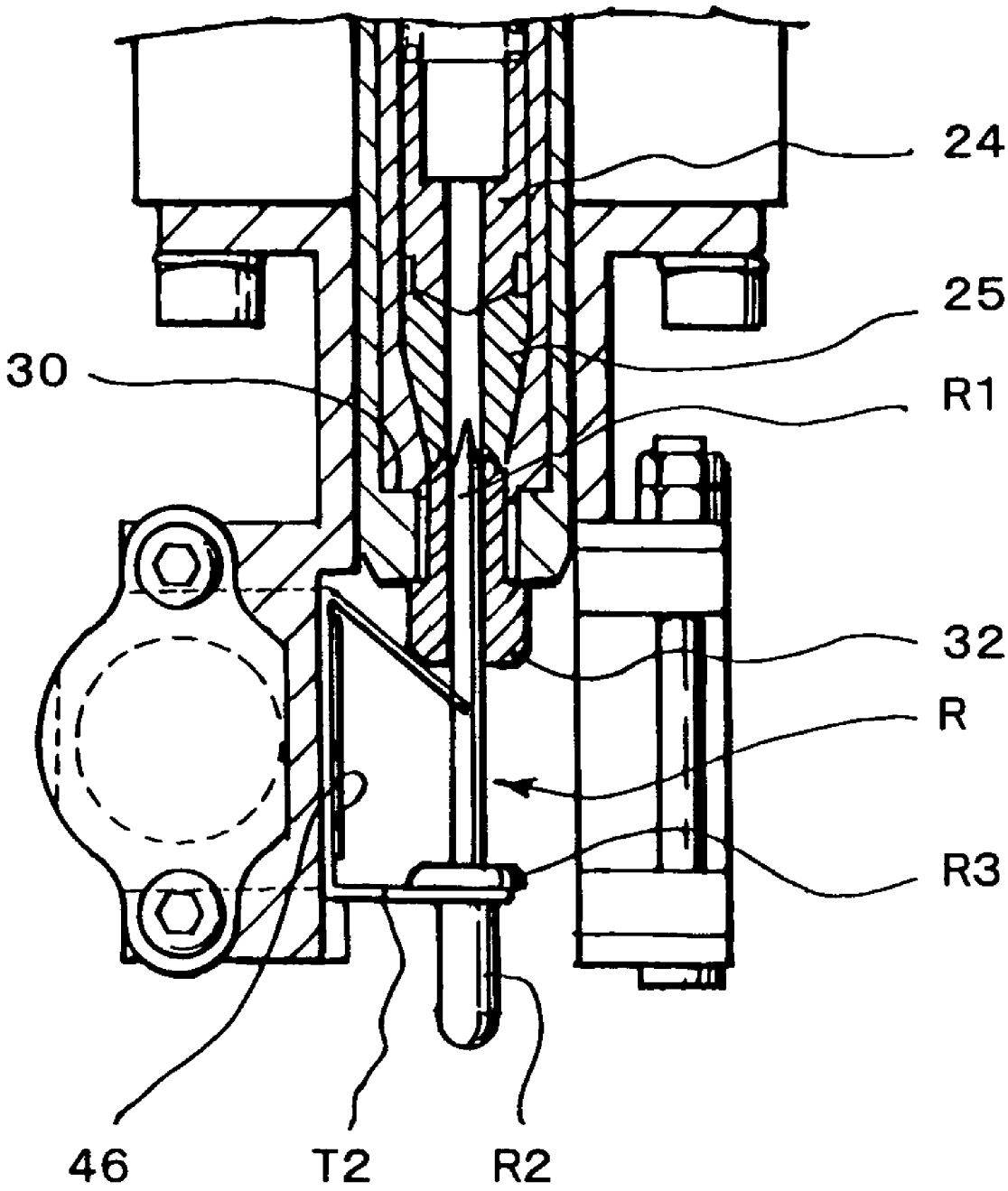
FIG. 22 is a frontal view of the conventional continuous riveter with the rivet supplying section partially cut off to show the relation between the nose piece and the blind rivet holder belt during descent of the nose piece.
Figure 23:
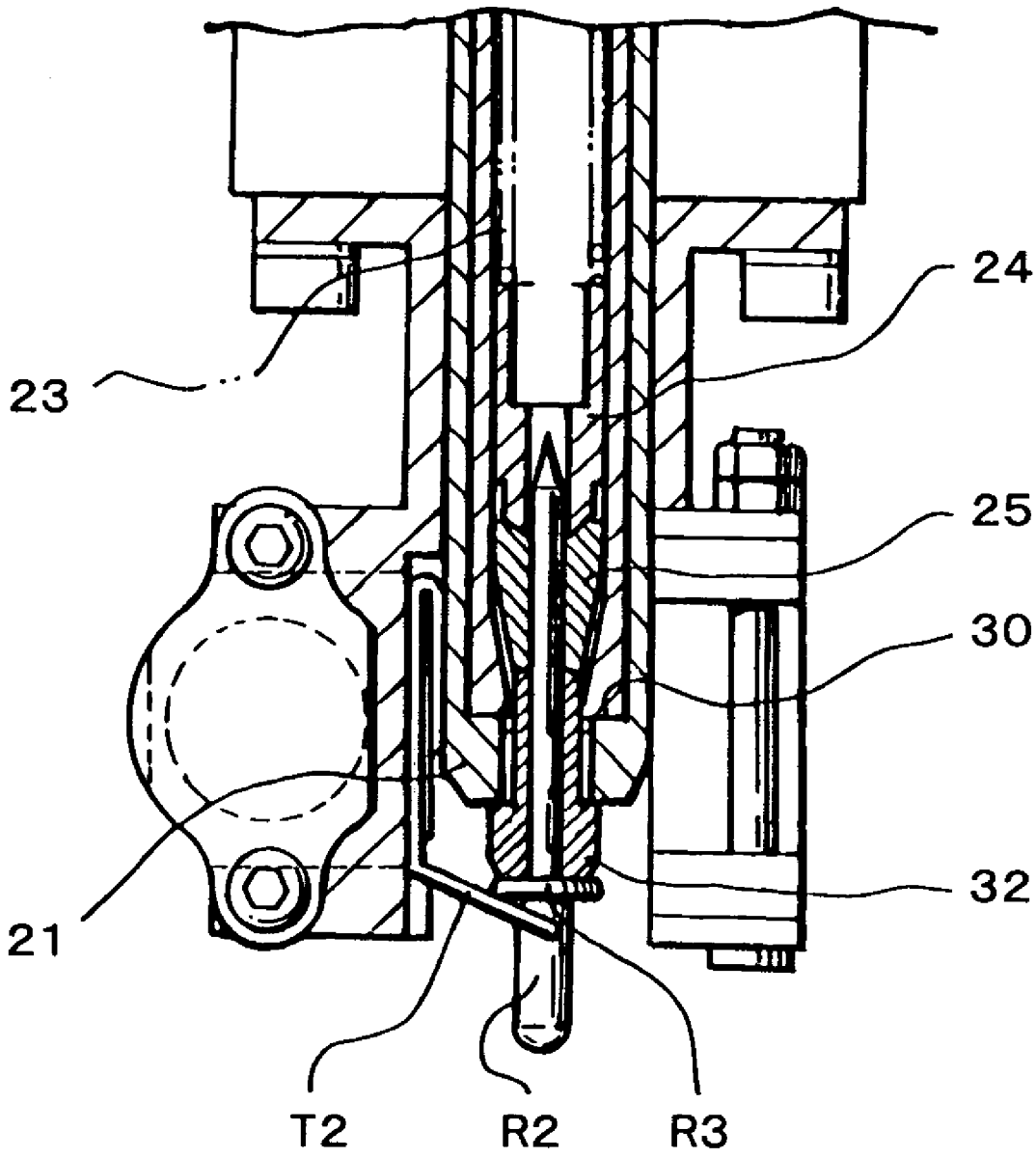
FIG. 23 is a frontal view of the conventional continuous riveter with the rivet supplying section partially cut off to show the relation between the nose piece and the blind rivet holder belt during descent of the nose piece.
Figure 24:
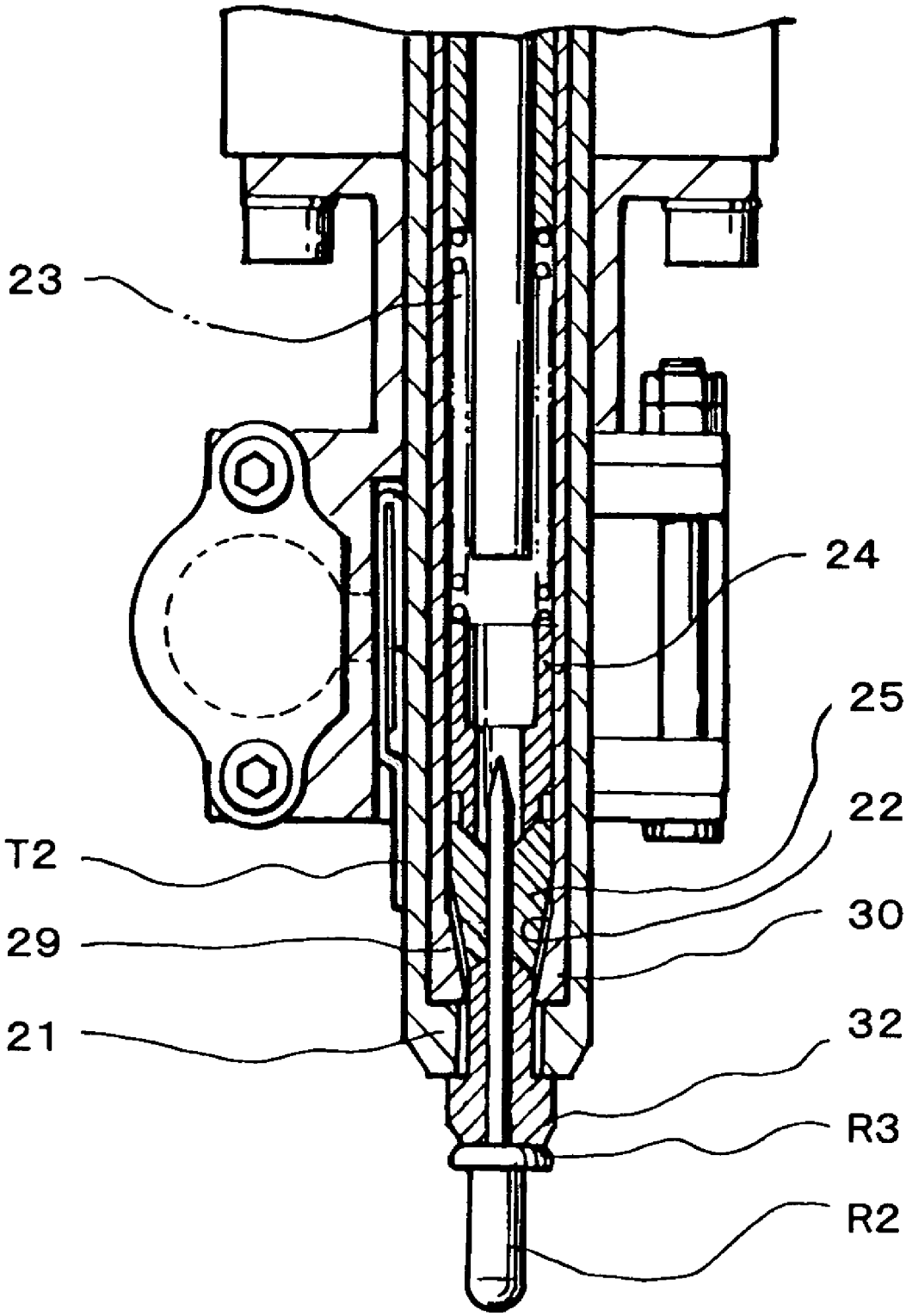
FIG. 24 is a frontal view of the conventional continuous riveter with the rivet supplying section partially cut off to show the relation between the nose piece and the blind rivet holder belt during descent of the nose piece.
Figure 25:
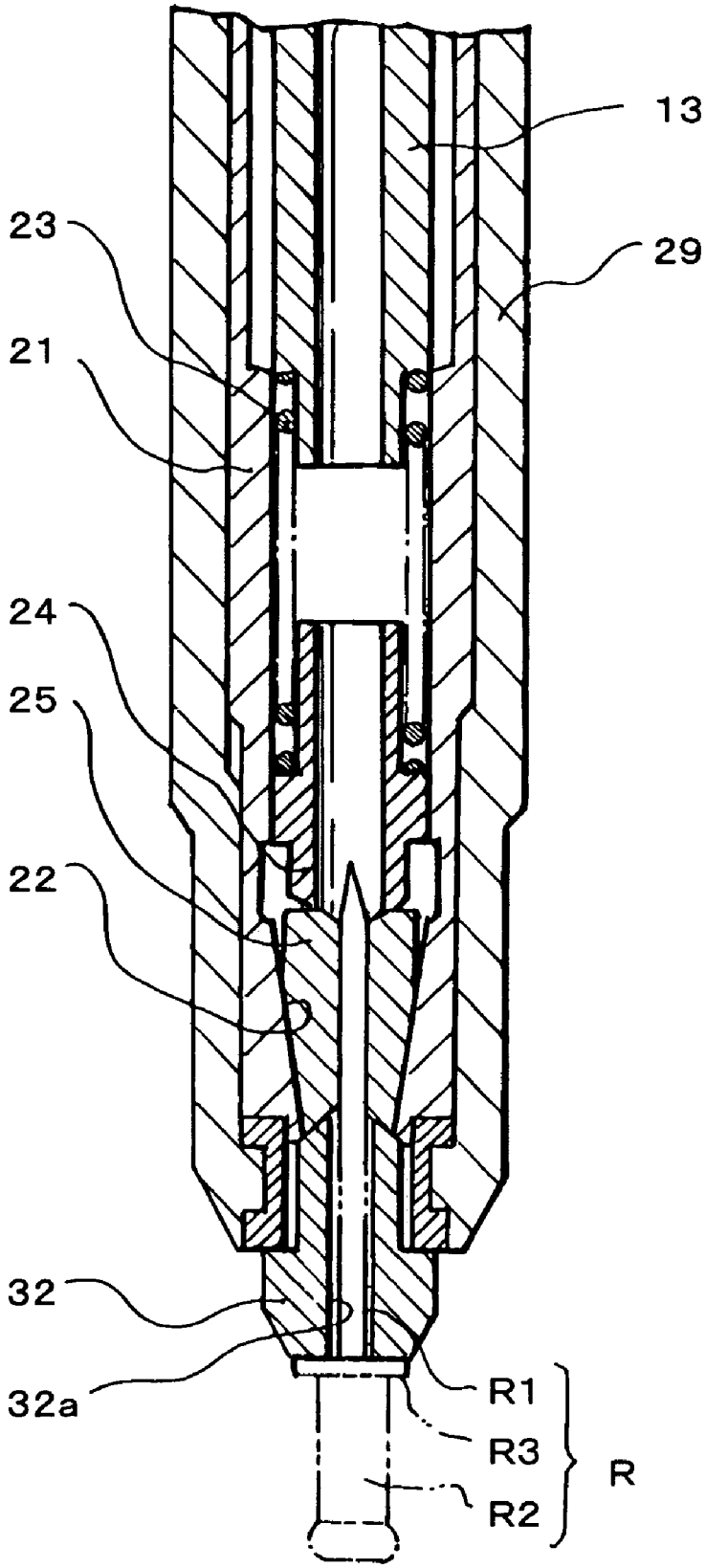
FIG. 25 is a partial longitudinal-sectional view showing an area around the nose piece of the conventional continuous riveter.
Figure 26:
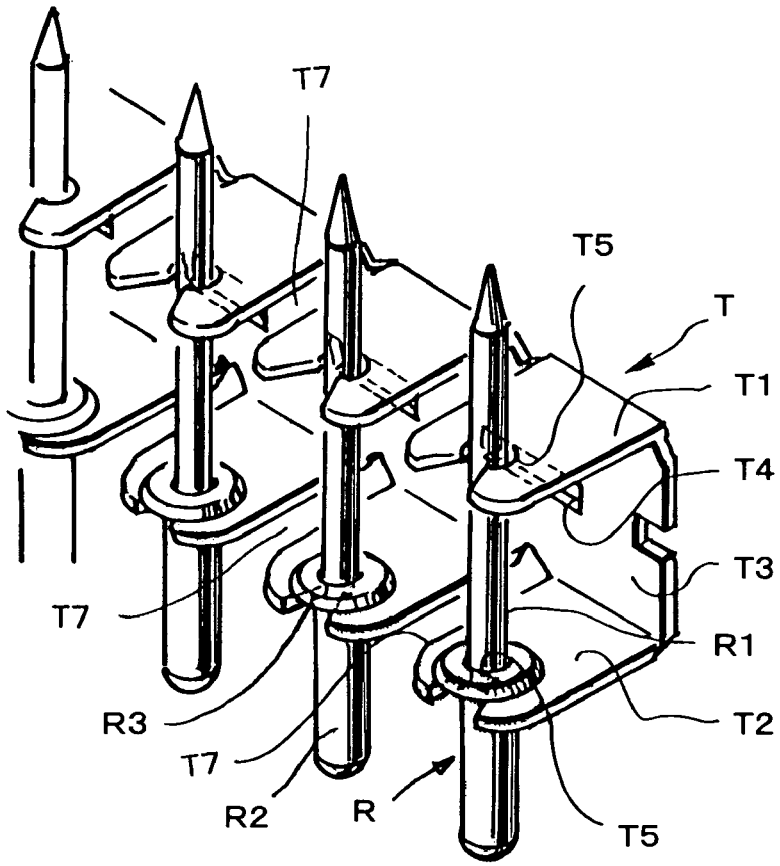
FIG. 26 is a perspective view showing an example of the blind rivet holder belt.
Figure 27:
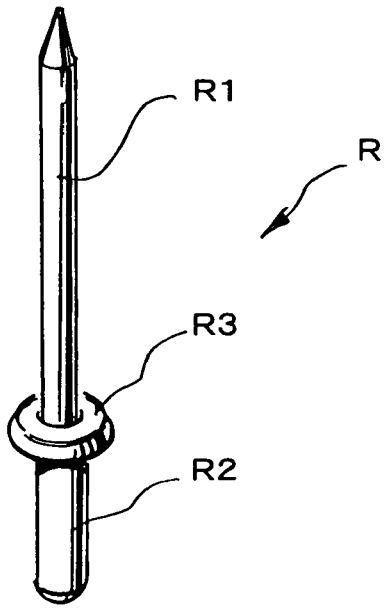
FIG. 27 is a perspective view of the blind rivet.

FIG. 11 show a rivet holder belt T for use in a continuous riveter of the present invention. FIG. 11(A) is a frontal view, FIG. 11(B) is a sectional view taken along the line B—B of FIG. 11(A), and FIG. 11(C) is a bottom view.

This rivet holder belt T is an elongated body shaped like the mirror image of the letter C. The elongated body has a vertical portion T3, upper tabs T1 along the upper edge of the vertical portion T3, and lower tabs T2 along the lower edge of the vertical portion T3. The upper and lower tabs are positioned at minute regular intervals. Each upper tab T1 is separated from an adjacent upper tab T1 by a narrow cut T7, and the same applies to the lower tabs. The upper tabs and the lower tabs are horizontally staggered in the longitudinal direction of the vertical portion T3.

Figure 31:
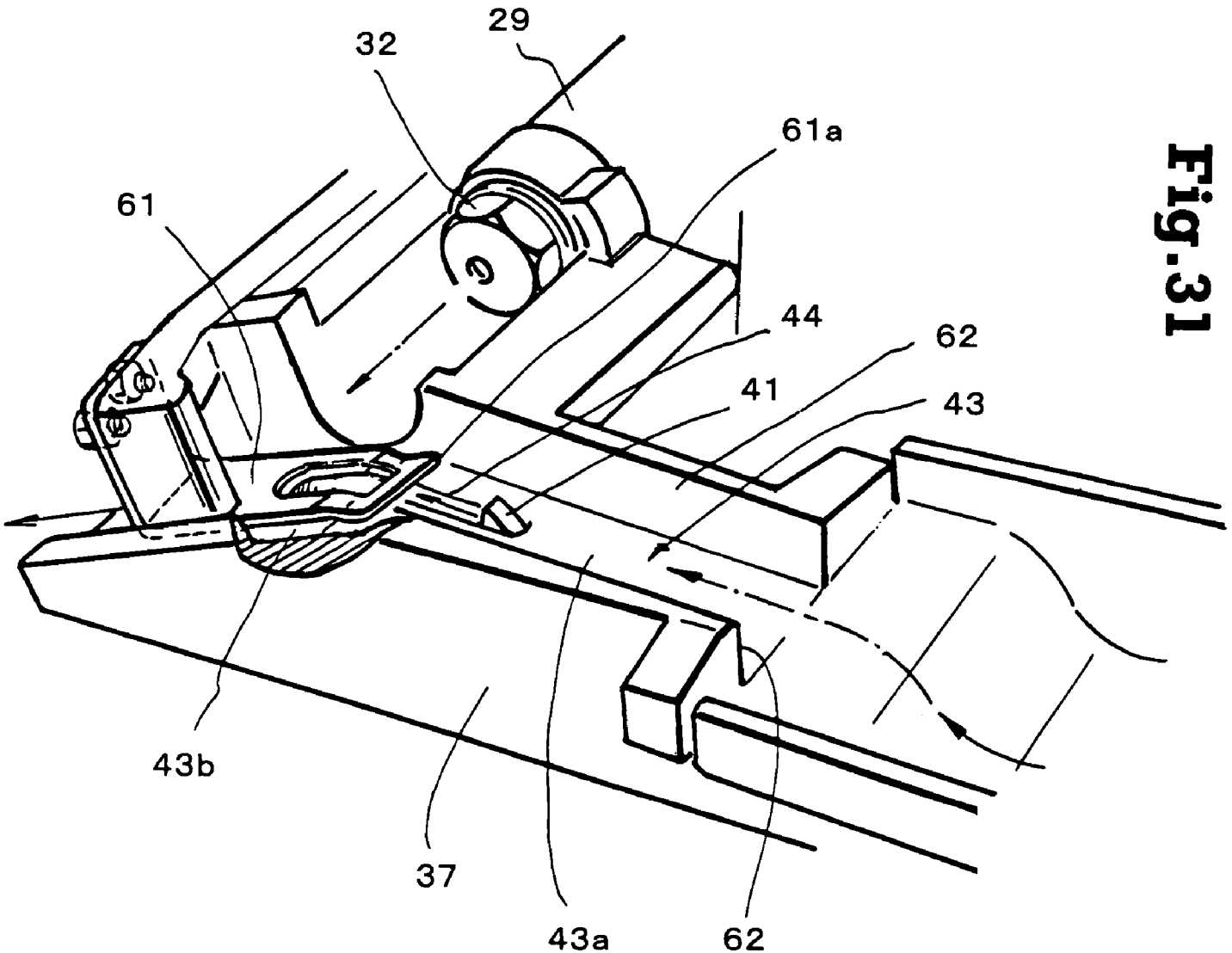
FIG. 31 is a perspective view showing a guide plate portion of this another prior art example.

Rectangular feed holes T4 for sending the holder belt T in a fixed direction are opened in the vertical portion T3. With the feed holes T4 and a feed claw 41 of a tape air cylinder 37 shown in FIGS. 28 and 31, the holder belt T is sent by one rivet at a time along a linear feed portion 43*a* of a guide plate to a bent portion 43*b*.

Figure 28:
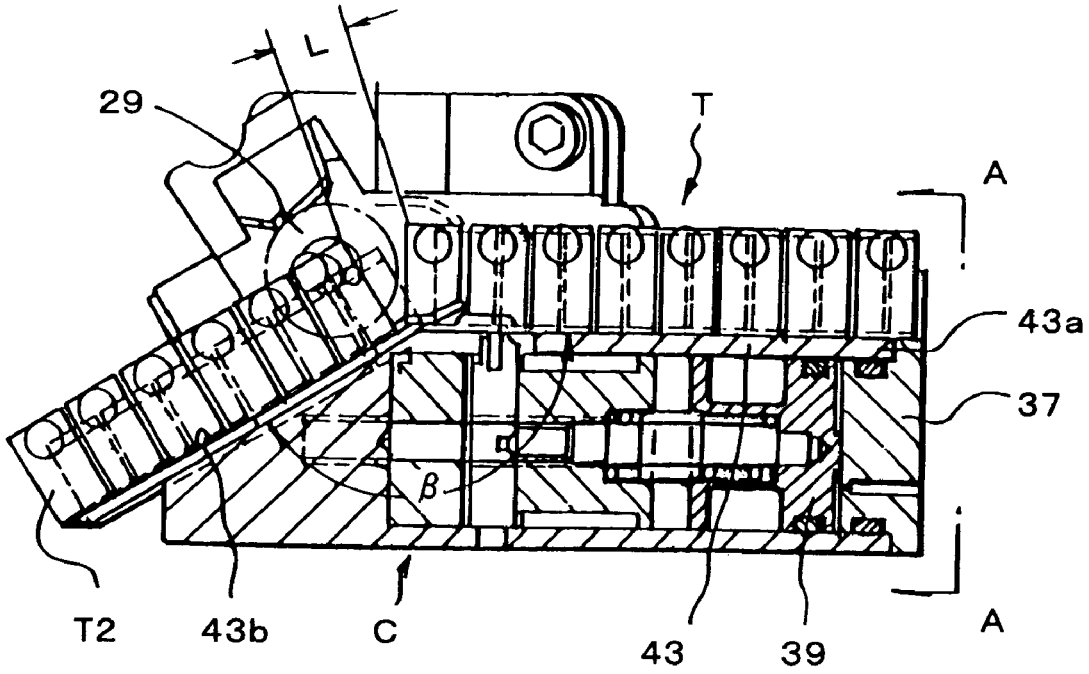
FIG. 28 is a bottom view showing another prior art example.
Figure 29:
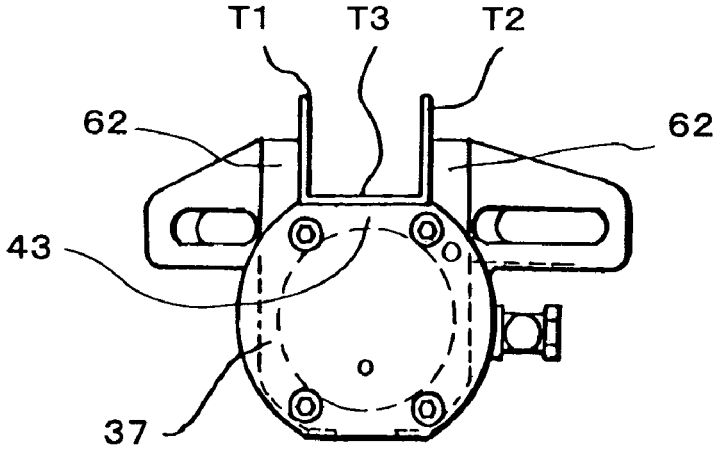
FIG. 29 is a view as seen from the direction of the arrow A-A of FIG. 28.

FIG. 28 is a bottom view of a continuous riveter in which the blind rivet holder belt of the present invention is used. FIG. 29 is a view as seen from the direction of the arrow A—A of FIG. 28, and shows how the rivet holder belt T is used.

As shown in FIG. 11, a first through hole T5 through which the shank R1 of the rivet R is inserted to be held is formed in the upper tab T1. The lower tab T2 has a second through hole T6 through which a rivet main body R2 is inserted to be held, with a head portion R3 of the rivet main body resting against the inner face of the lower tab T2. The first through hole T5 and the second through hole T6 each have a slant face which is formed in the axial center direction to fit to the outer circumference of the rivet R.

The first through hole T5 and the second through hole T6 are each shaped like a bay to make the shank R1 and the rivet main body R2 of the rivet R detachable.

A groove T8 as an oblique fold line connecting the cut T7 of the upper tab T1 to the cut T7 of the lower tab T2 is formed on the inner face side of the vertical portion T3. The blind rivet holder belt T is bent on the groove T8, forming an angle β between the linear feed portion 43*a* and the bent portion 43*b* of the guide plate (FIG. 28). FIG. 11C shows the bent state.

FIG. 11B shows in section the groove T3.

Figure 30:
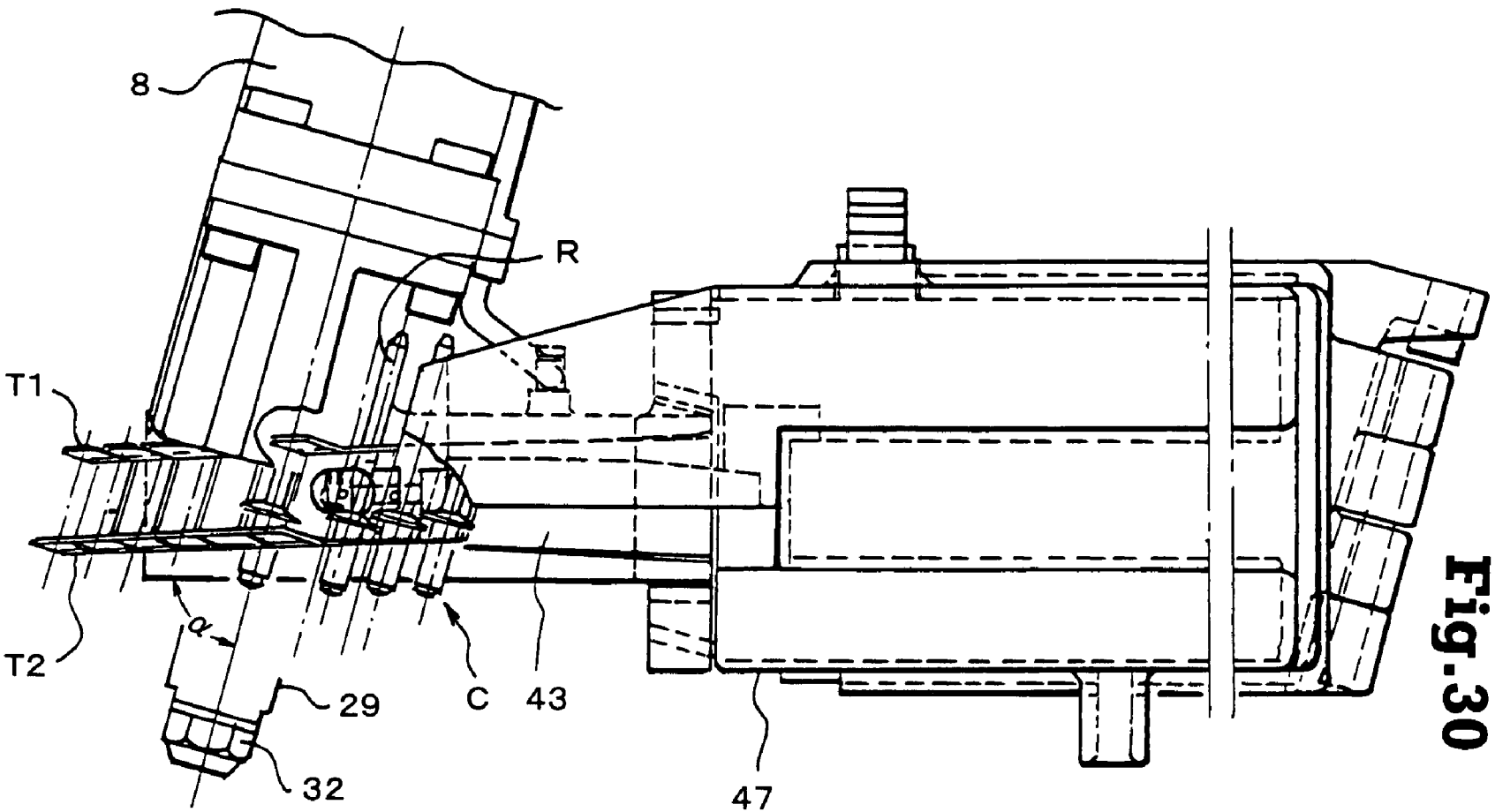
FIG. 30 is a side view of this another prior art example.

To use the blind rivet holder belt T of the present invention, the long blind rivet holder belt T shown in FIG. 11 is wound into a loop of a given length and loaded in a storage case 47 shown in FIG. 30. Then the outer tip of the rivet holder belt is pulled until the tip reaches an end of the liner feed portion 43*a* of the U-shaped guide plate.

In this case, a tubular body 29 of the continuous riveter protrudes downward (not shown in the drawing) passing through an area of the bent portion 43*b* (FIG. 31) where the blind rivet holder belt T is not present. In FIGS. 28 and 30, the riveter is in the process of continuous caulking and therefore the blind rivet holder belt is traveling along the bent portion 43*b*.

Figure 32:
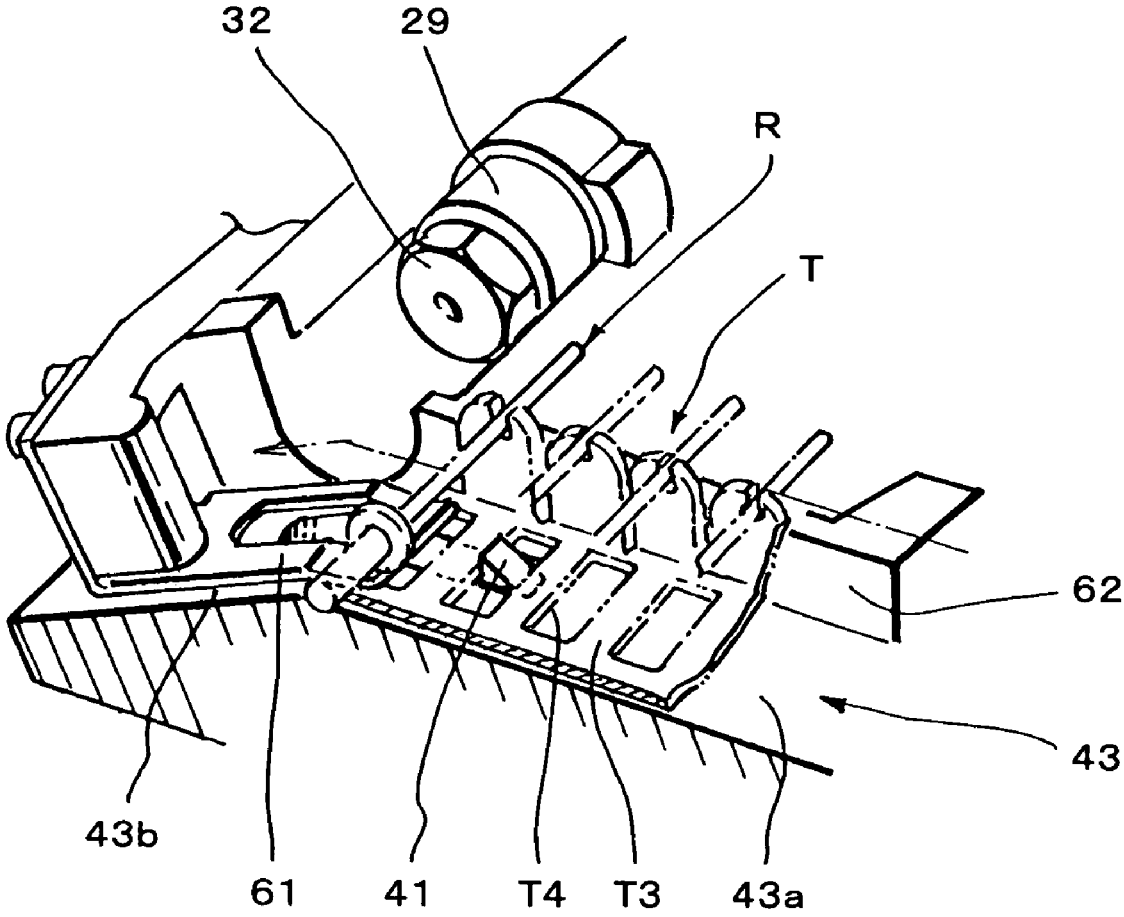
FIG. 32 is a perspective view showing how the guide plate portion is used in this another prior art example.
Figure 33:
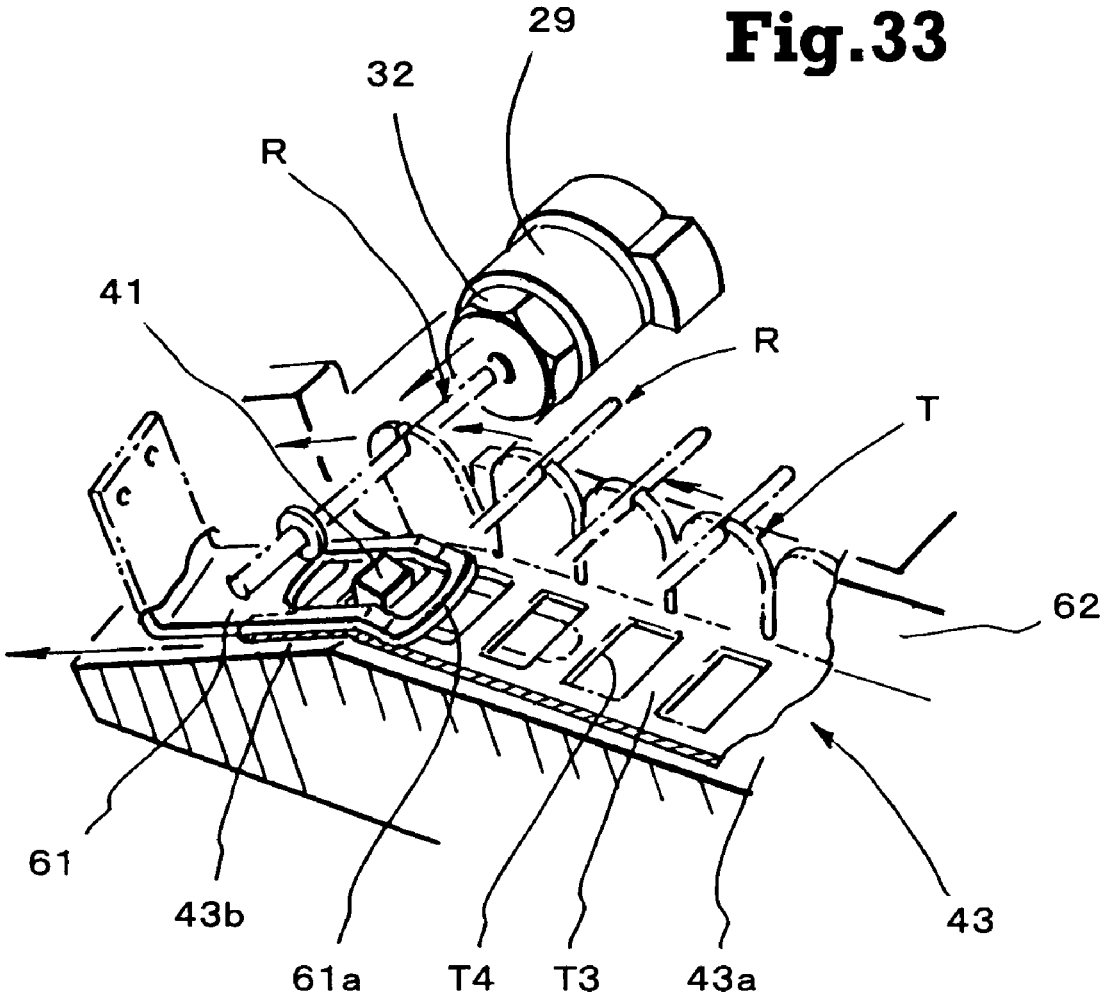
FIG. 33 is a perspective view showing how the guide plate portion is used in the next step.

Next, an operation handle of the continuous riveter is pulled to raise the tubular body 29 and is released to move the feed claw 41 of the tape air cylinder 37 shown in FIGS. 28 and 32 to thereby feed one rivet R. This causes the blind rivet holder belt T to bend at the groove T8, so that the front portion of the blind rivet holder belt T that corresponds to one rivet R is bent at an angle of B. At the same time, the front portion of the rivet holder belt T is sent to the bent portion 43*b*, the tubular body 29 descends while bending the upper and lower tabs T1 and T2 downward. The rivet R is thus inserted through the hole in the nose piece 32 and held by jaws 25. At this time, the rivet R is detached from the first and second through holes T5 and T6.

Figure 34:
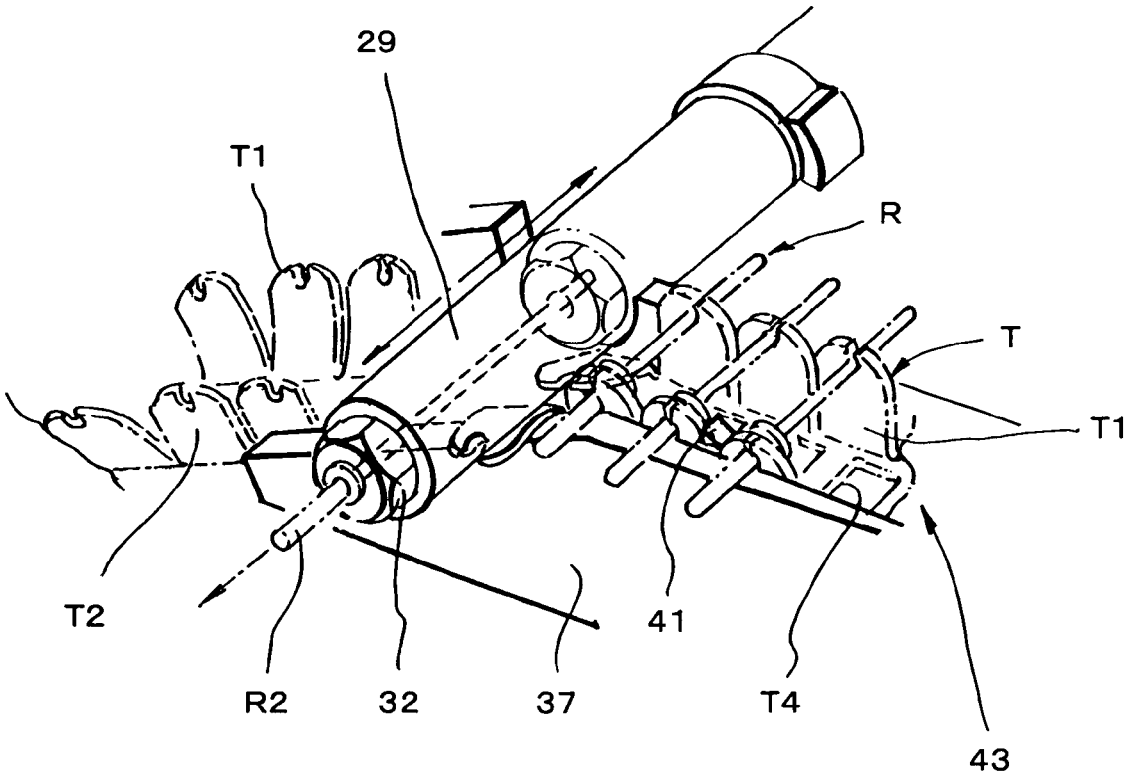
FIG. 34 is a perspective view showing how the guide plate portion is used in the step after the next step.
Figure 35:
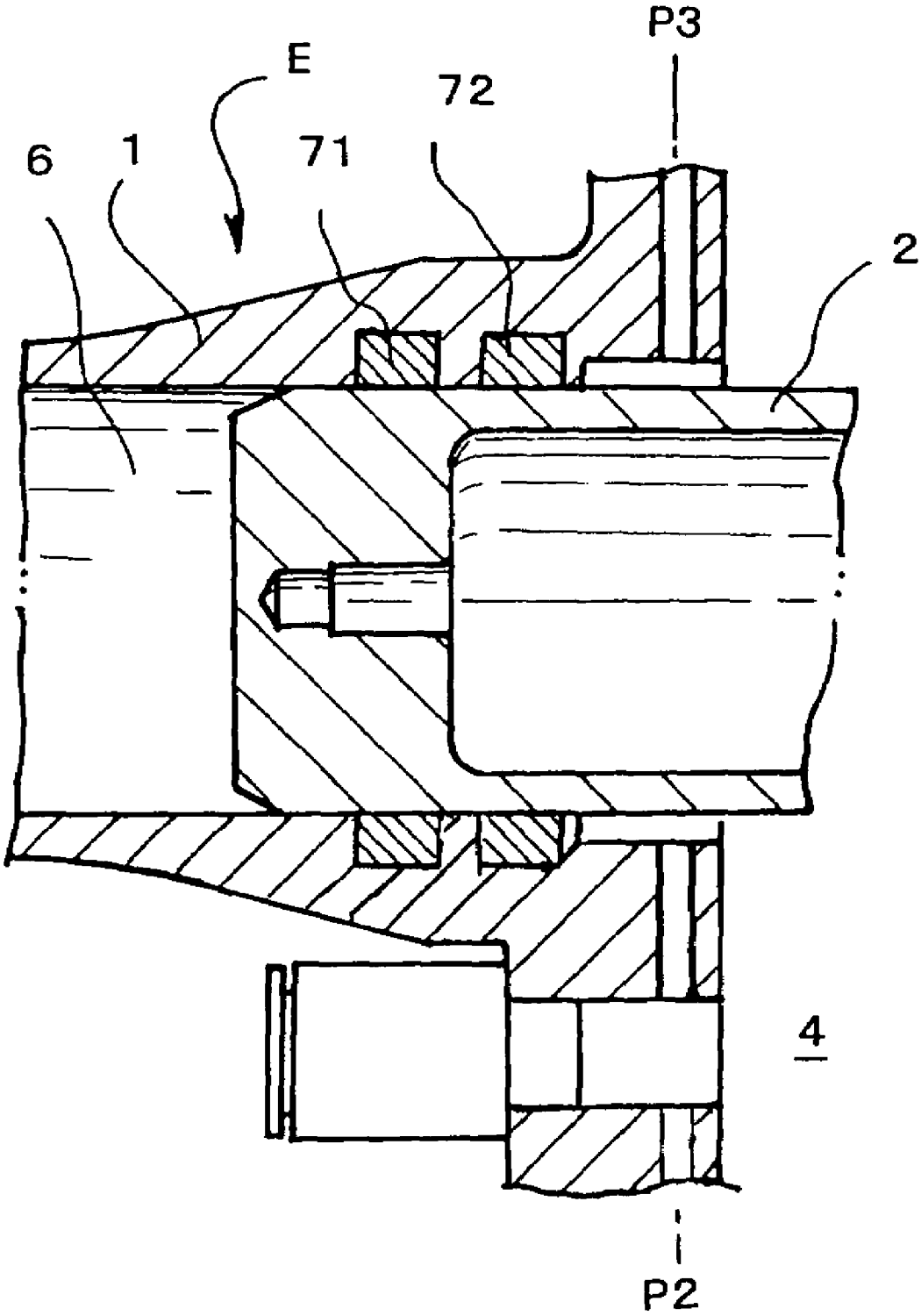
FIG. 35 is an enlarged sectional view of a prior art example which corresponds to the portion A of FIG. 1.
Figure 36:
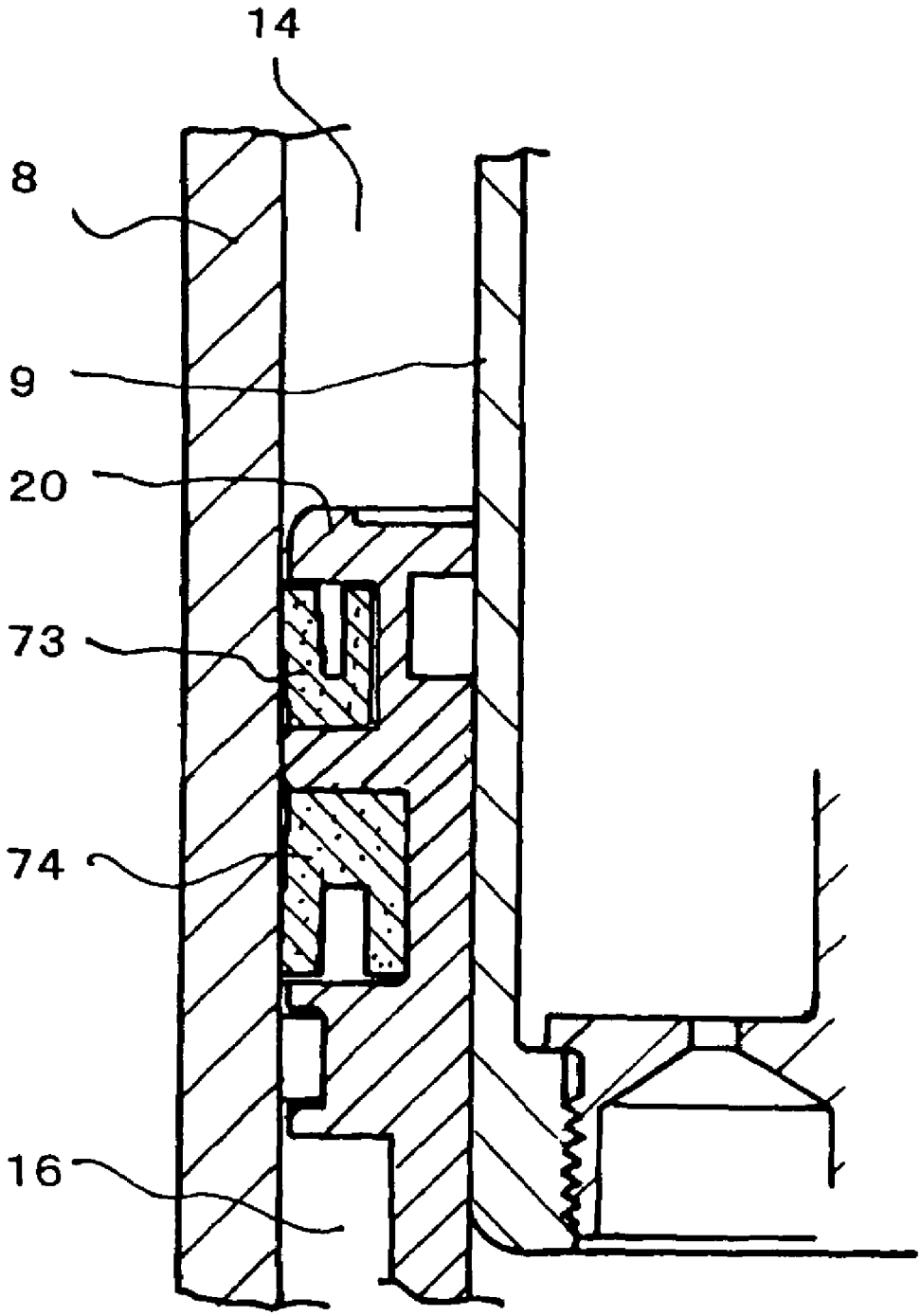
FIG. 36 is an enlarged sectional view of a prior art example which corresponds to the portion B of FIG. 1.
Figure 37:
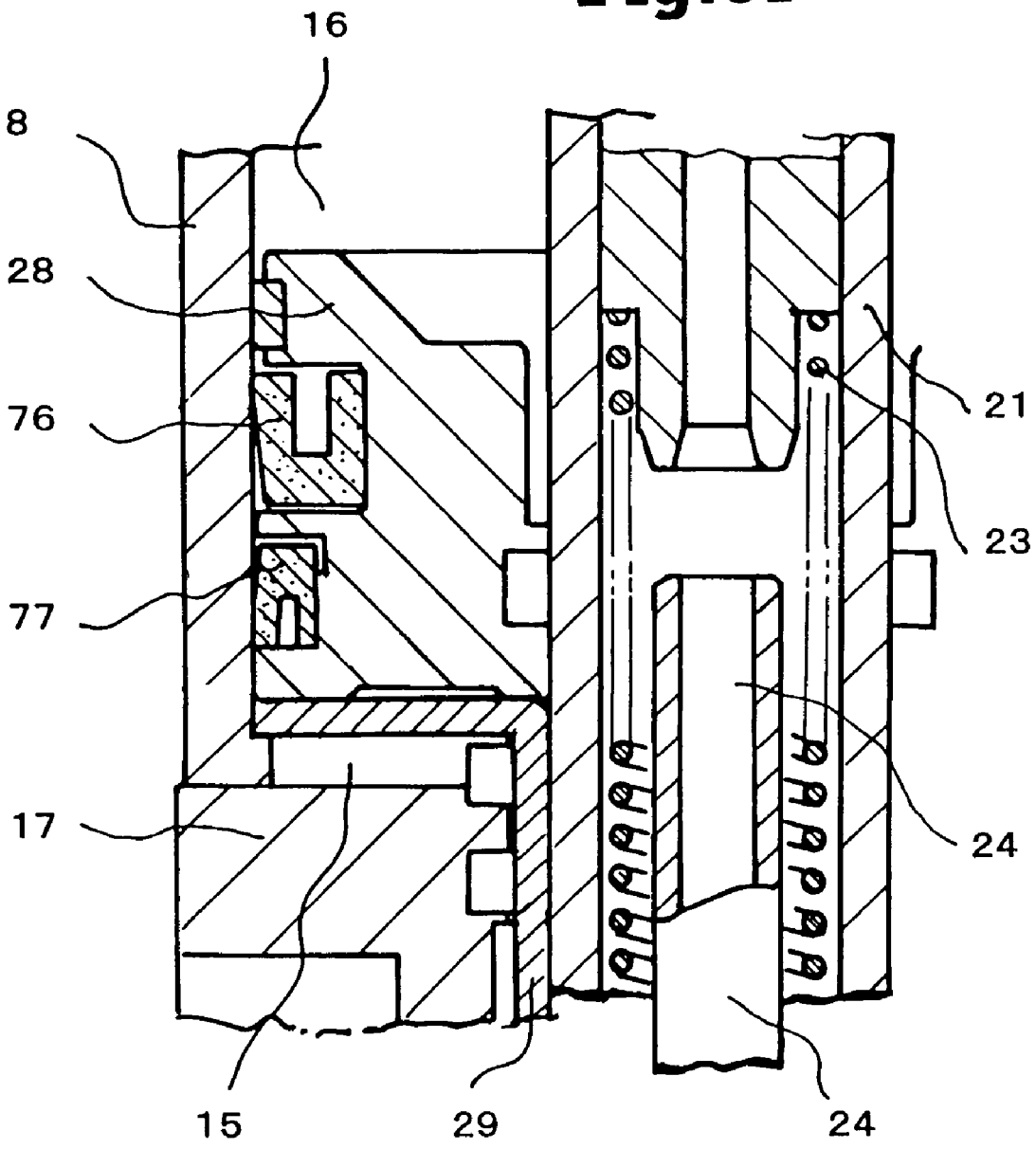
FIG. 37 is an enlarged sectional view of a prior art example which corresponds to the portion C of FIG. 1.

The bent state of the upper and lower tabs T1 and T2 is identical with that of the conventional blind rivet holder belt T1 and is shown in FIG. 34.

In this state, the rivet main body R2 and the head portion R3 of the rivet R protrude from the nose piece 32. The protruding rivet R2 is inserted into a hole in sheet metal H. Then the operation handle is pulled, thus raising the shank R1 held by the jaws 25 and squashing the rivet R2 for caulking. The shank R1 is cut off and collected. Next, the noise piece 32 and the tubular body 29 are raised. As the operation lever is released, the feed claw 41 sends the blind rivet holder T forward by one rivet R and the tubular body 29 descends while bending the upper and lower tabs T1 and T2 downward. The rivet R is gripped and now the riveter is ready for the next caulking.

In FIGS. 28 and 30, the upper and lower tabs T4 and T5 are depicted as having returned from the bent state after the rivet R is used for caulking.

As can be seen in FIG. 28, the blind rivet holder belt T of the present invention is bent between a pair of upper and lower tabs T1 and T2 which holds the rivet R that is about to be fired for caulking and the immediately preceding pair of upper and lower tabs T1 and T2 to leave a gap L between the two pairs of tabs at the tip. With the slight cut T7 cut between adjacent tabs, the tabs holding the rivet R that is to be used in the next round of caulking do not interfere with descent of the tubular body 29 even if the pitch between one rivet R and its adjacent rivet R is small. In addition, owing to the fold line T8, the rivet holder belt T is bent securely and reliable riveting is achieved.

Therefore, riveting with the continuous riveter of the present invention and the above rivet holder belt T yields secure caulking. That is, the guide plate 43 has the linear feed portion 43*a* and the bent portion 43*b* so that the rivet holder belt T can be bent along the bent portion 43*b* without fail. Bending the rivet holder belt T widens the rivet linkage pitch as shown in FIG. 28 and therefore descent of the tubular body 29 is not hindered. Since the rivet holder belt T is bent at a given angle without fail, the shank of the rivet R can be securely placed on the center line of the tubular body 29 and accurate riveting is achieved.

INDUSTRIAL APPLICABILITY

As has been described, a continuous riveter according to the present invention can fire in succession rivets for caulking metal sheet or the like and can also fire aircraft rivets in succession.

The invention claimed is:

1. A continuous riveter, comprising:

a chuck cylinder comprising an oil chamber and air chambers provided on one side and another side of said oil chamber, said oil chamber and air chamber on the one side being separated by a slidable jaw case piston, said oil chamber and said air chamber on said another side being separated by a slidable nose piston, and the oil chamber being located between said jaw case piston and said nose piston;

an oil cylinder fixed and mounted to said chuck cylinder, said oil cylinder comprising an oil chamber connected to the oil chamber of said chuck cylinder through a vent, and an oil piston driven by an air cylinder; connected to said oil cylinder, said oil piston being formed integrally with a piston rod of a piston of said air cylinder, said oil piston separating said oil chamber of said oil cylinder and an air chamber of said air cylinder a tubular body fixed and attached to said nose piston of said chuck cylinder, extending outside a tube from an end portion of said chuck cylinder, advanced and retracted by said nose piston, and having an opening in a front end surface of said tubular body;

a nose piece having an insertion hole to which a shank of a blind rivet is inserted, drilled therein, and fixed and attached to the opening in the front end surface of said tubular body;

a tubular jaw case fixed and attached to said jaw case piston, extending into said tubular body to be slidably inserted into said tubular body, advanced and retracted in said tubular body by said jaw case piston, said tubular jaw case comprising:

a hole, to which the shank of the blind rivet is inserted, drilled in a front end surface of said jaw case coaxially with said insertion hole of said nose piece, said hole being reduced in diameter toward the front end so that an inner face of the front end of the jaw case is formed as a tapered face;

a pair of jaws positioned in the tapered face on the inner face of the front end of said jaw case, and slidably interpolated in the front end of said jaw case for gripping and releasing the shank of a blind rivet that is inserted through the insertion hole of the nose piece and the hole;

a spring located on a rear side of the jaws in said jaw case for directing the jaws toward the front end of the jaw;

a shank recovery pipe for connecting an upper end of the jaw case and a shank storing case provided on an upper portion of said chuck cylinder; and a vacuum ejector for decompressing the shank storing case and exerting a suction force on the shank recovery pipe, a shank of a blind rivet which is cut off upon riveting being sucked through the shank recovery pipe by the vacuum ejector and collected in a shank sorting case, said vacuum ejector actuated constantly while the riveter is in use to hold a blind rivet inserted in a jaw portion through the hole in the front end of said jaw case from the insertion hole of the nose piece provided in the front end of said tubular nose of said nose piston with a suction force of said vacuum ejector;

an oil chamber side seal member of said oil cylinder and an air chamber side seal member of said air cylinder provided in a slide surface of the oil piston on an inner surface of the oil cylinder where the oil piston separates the oil chamber of the oil cylinder from said air chamber of said air cylinder, said oil cylinder between the seal members having an air vent; and an oil chamber side seal member and an air chamber side seal member provided in the jaw case piston and the nose piston for separating the oil chamber and the air chambers of said chuck cylinder and on slide surfaces between the jaw case piston and the inner surface of said chuck cylinder, and the nose piston and the inner surface of the chuck cylinder, for sealing areas between the oil chamber and he air chambers, said jaw case piston and said nose piston between the seal members each having an air vent.

2. A continuous riveter according to claim 1, further comprising:

a rivet supplying section comprising a storage case and a tape air cylinder, the storage case storing a blind rivet holder belt wound into a loop, the blind rivet holder being loaded with blind rivets, and the tape air cylinder guiding the blind rivet holder belt along a guide plate to supply the blind rivets, said blind rivets being loaded in the blind rivet holder belt, one by one;

a guide plate extending from the storage case of the rivet supplying section having a linear feed portion of a predetermined length and a bent portion which is continuous from the linear feed portion and where a vertical portion of the blind rivet holder belt is bent at a predetermined angle;

a pressing plate extending over a guide surface from the linear feed portion to the bent portion of the guide plate to guide the blind rivet holder belt while pressing down on the vertical portion of the blind rivet holder belt, the pressing plate guiding, from the linear feed portion to the bent portion, the blind rivet holder belt that has been fed linearly by a feed claw to bend the blind rivet holder, the feed claw making a linear reciprocating motion due to the tape air cylinder; and a tubular body fixed and attached to the nose piston is positioned on the axial center of a shank of a blind rivet held by an upper tab and a lower tab situated immediately past the bent portion where the blind rivet holder belt is bent after passing the linear feed portion of the guide plate, the axial center of the shank and the axial center of the tubular body coinciding with each other.

3. A continuous riveter according to claim 1, wherein hole communicated with the insertion hole from an outer circumferential face of the nose piece are drilled in the nose piece provided on the front end of the tubular body fixed and attached to the nose piston.

4. A continuous riveter according to claim 2, wherein plural suction-force dispersing holes communicated with the insertion hole from an outer circumferential face of the nose piece are drilled in the nose piece provided on the front end of the tubular body fixed and attached to nose piston.

5. A continuous riveting method of loading blind rivets;

in a specific blind rivet holder belt in a specific continuous the method comprising:

providing a chuck cylinder comprising an oil chamber and air chambers provided on one side and another side of said oil chamber, said oil chamber and said air chamber on the one side being separated by a slidable jaw case piston, said oil chamber and said air chamber on said another side being separated by a slidable nose piston, said oil chamber being located between said jaw case piston and said nose piston;

providing an oil cylinder fixed and mounted to said chuck cylinder, said oil cylinder comprising an oil chamber connected to the oil chamber of said chuck cylinder through a vent and an oil piston driven by an air cylinder connected to said oil cylinder, said oil piston being formed integrally with a piston rod of a piston of said air cylinder, said oil piston separating said oil chamber of said oil cylinder and an air chamber of said air cylinder;

providing a tubular body fixed and attached to said nose piston of said chuck cylinder, extending outside a tube from an end portion of said chuck cylinder, advanced and retracted by said nose piston, and having an opening in a front end surface of said tubular body;

providing a nose piece having an insertion hole to which a shank of a blind rivet is inserted, drilled therein, and fixed and attached to the opening in the front end surface of said tubular body;

providing a tubular jaw case fixed and attached to said jaw case piston, extending into said tubular body to be slidably inserted into said tubular body, advanced and retracted in said tubular body by said jaw case piston, said tubular jaw case comprising:

a hole, to which the shank of the blind rivet is inserted, drilled in a front end surface of said jaw case coaxially with said insertion hole of said nose piece, said hole being reduced in diameter toward the front end so that an inner face of the front end of the jaw case is formed as a tapered face;

a pair of jaws positioned in the tapered face on the inner face of the front end of said jaw case, and slidably interpolated in the front end of said jaw case for gripping and releasing the shank of a blind rivet that is inserted through the insertion hole of the nose piece and the hole;

a spring located on a rear side of the jaws in said jaw case for biasing the jaws in a direction toward the front end of the jaw case through an intermediation of a jaw pusher;

a shank recovery pipe for connecting an upper end of the jaw case and a shank storing case provided on an upper portion of said chuck cylinder; and a vacuum ejector for decompressing the shank storing case and exerting a suction force on the shank recovery pipe through an intermediation of the shank storing case, a shank of a blind rivet which is cut off upon riveting being sucked through the shank recovery pipe by the vacuum ejector to be collected in the shank sorting case, the vacuum ejector actuated constantly while the riveter is in use to hold a blind rivet inserted in a jaw portion through the hole in the front end of said jaw case from the insertion hole of the nose piece provided in the front end of said tubular nose of said nose piston with a suction force of said vacuum ejector;

providing an oil chamber side seal member of said oil cylinder and an air chamber side seal member of said air cylinder provided in a slide surface of the oil piston on an inner surface of the oil cylinder where the oil piston separates the oil chamber of the oil cylinder from said air chamber of said air cylinder, said oil cylinder between the seal members having an air vent;

providing an oil chamber side seal member and an air chamber side seal member which provided in the jaw case piston and the nose piston for separating the oil chamber and the air chambers of said chuck cylinder and on slide surfaces between the jaw case piston and the inner surface of said chuck cylinder, and the nose piston and the inner surface of the chuck cylinder, for sealing areas between the oil chamber and the air chambers, said jaw case piston and said nose piston between the seal members each having an air vent;

providing a rivet supplying section that has a storage case and a tape air cylinder, said storage case storing the blind rivet holder belt wound into a loop, said blind rivet holder being loaded with blind rivets, said tape air cylinder guiding the blind rivet holder belt along a guide plate to supply the blind rivets of the blind rivet holder belt one by one, said guide plate extending from said storage case of the rivet supplying section, said guide plate having a linear feed portion of a predetermined length and a bent portion which is continuous from the linear feed portion and where a direction of a vertical portion of the rivet holder belt is bent at a predetermined angle;

providing a pressing plate extending over a guide surface from the linear feed portion to the bent portion of the guide plate to guide the blind rivet holder belt by pressing down on the vertical portion of the blind rivet holder belt; and providing a feed claw that is put into a linear reciprocating motion due to the tape air cylinder to linearly feed the blind rivet holder belt, said blind rivet holder belt being guided by the pressing plate from the linear feed portion to the bent portion to be bent, positioning the tubular body of the nose piston on the axial center of a shank of a blind rivet held by an upper tab and a lower tab of said blind rivet holder belt, said upper and lower tabs being situated immediately past the bent portion where the blind rivet holder belt is bent after passing the linear feed portion of the guide plate, the axial center of the shank and the axial center of the tubular body coinciding with each other, said blind rivet holder belt comprising:

an elongated body, a vertical portion of the elongated body having upper tabs and lower tabs along its upper and lower edges at minute regular intervals, one tab and its adjacent tab being separated from each other by a narrow cut;

feed holes formed in the vertical portion to send the elongated body in a fixed direction;

a first through hole formed in each of the upper tabs to hold a shank of a blind rivet that is inserted through the first through hole; and a second through hole formed in each of the lower tabs to hold a rivet main body of a blind rivet that is inserted through the second through hole with a head portion of the rivet main body resting against an inner face of the lower tab, the upper tabs and the lower tabs being horizontally staggered in a longitudinal direction of the vertical portion, the first and second through holes being slanted at an angle that is adjusted to an outer circumference of the shank and the rivet main body of the blind rivet inserted obliquely, cuts between the upper tabs and cuts between the lower tabs are being connected by oblique fold lines formed on an inner face of the vertical portion.

6. A continuous caulking method of blind rivets according to claim 5, wherein plural suction-force dispersing holes communicated with the insertion hole from an outer circumferential face the nose piece are drilled in the nose piece provided on the front end of the tubular body fixed and attached to the nose piston.

7. A continuous riveter comprising:

a slidable jaw case piston;

a nose piston;

a nose piece having an insertion hole to which a shank of a blind rivet is inserted, and attached to the opening in the front end surface of said tubular body a chuck cylinder comprising an oil chamber and air chambers on one side and another side of said oil chamber, said oil chamber and air chamber on the one side being separated by said slidable jaw case piston, said oil chamber and said air chamber on said another side being separated by slidable said nose piston, and the oil chamber being located between said jaw case piston and said nose piston; a tubular body attached to said nose piston, said tubular body extending to outside of said chuck cylinder; a tubular jaw case attached to said jaw case piston, said jaw case moving up and down within said tubular body; an oil cylinder mounted to said chuck cylinder, said oil cylinder comprising an oil chamber connected to the oil chamber of said chuck cylinder through a vent, and an oil piston driven by an air cylinder connected to said oil cylinder, said oil piston being formed integrally with a piston rod of a piston of said air cylinder, said oil piston separating said oil chamber of said oil cylinder and an air chamber of said air cylinder; means for gripping and releasing a shank of a blind rivet inserted through an insertion hole of said nose piece; a shank recovery pipe connected to an upper end of said jaw case; a means for decompressing a shank storing case and exerting a suction force on said shank recovery pipe for sucking in a shank of a blind rivet and ejecting the shank; an oil chamber side seal member of said oil cylinder and an air chamber side seal member of said air cylinder provided in a slide surface of the oil piston on an inner surface of the oil cylinder, said oil piston separating the oil chamber of the oil cylinder from said air chamber of said air cylinder, said oil cylinder between the seal members having an air vent; and an oil chamber side seal member and an air chamber side seal member provided in said jaw case piston and said nose piston for separating the oil chamber and the air chambers of said chuck cylinder and on slide surfaces between said jaw case piston and the inner surface of said chuck cylinder, and the nose piston and the inner surface of the chuck cylinder, for sealing areas between the oil chamber and the air chambers, said jaw case piston and said nose piston between the seal members each having an air vent.

* * * * *